US012167770B2

(12) United States Patent
Christensen et al.

(10) Patent No.: US 12,167,770 B2
(45) Date of Patent: Dec. 17, 2024

(54) VACUUM PUMP ASSEMBLY FOR ARTICLE OF FOOTWEAR

(71) Applicant: Reebok International Limited, Altrincham (GB)

(72) Inventors: Brian Christensen, Centerville, MA (US); Erasmo Rodriguez, Boston, MA (US); Henry L. Hardigan, Siler City, NC (US); Ricardo Vestuti, Providence, RI (US); Brian John Hamilton, North Billerica, MA (US)

(73) Assignee: Reebok International Limited, Altrincham (GB)

( * ) Notice: Subject to any disclaimer, the term of this patent is extended or adjusted under 35 U.S.C. 154(b) by 242 days.

(21) Appl. No.: 17/065,189

(22) Filed: Oct. 7, 2020

(65) Prior Publication Data

US 2022/0104582 A1 Apr. 7, 2022

(51) Int. Cl.

| | |
|---|---|
| ***A43B 13/20*** | (2006.01) |
| ***A43B 7/083*** | (2022.01) |
| ***A43B 23/02*** | (2006.01) |

(52) U.S. Cl.

CPC ..... *A43B 13/203* (2013.01); *A43B 7/083* (2022.01); *A43B 23/029* (2013.01)

(58) Field of Classification Search

CPC ..... A43B 13/20; A43B 13/203; A43B 23/029; A43B 7/083

See application file for complete search history.

(56) References Cited

U.S. PATENT DOCUMENTS

| | | | | |
|---|---|---|---|---|
| 3,685,176 | A * | 8/1972 | Rudy | A43B 5/0407 36/71 |
| 4,912,861 | A * | 4/1990 | Huang | A43B 13/206 36/71 |
| 5,113,599 | A | 5/1992 | Cohen et al. | |
| 5,383,290 | A * | 1/1995 | Grim | A43B 13/206 36/88 |
| 5,392,534 | A * | 2/1995 | Grim | A43B 7/147 36/154 |
| 5,590,696 | A | 1/1997 | Phillips et al. | |
| 5,617,650 | A * | 4/1997 | Grim | A43B 7/147 36/154 |
| 5,893,219 | A | 4/1999 | Smith et al. | |
| 5,987,779 | A * | 11/1999 | Litchfield | A43B 3/34 36/29 |
| 6,189,172 | B1 * | 2/2001 | Baek | A43B 5/0407 36/117.6 |
| 6,230,501 | B1 * | 5/2001 | Bailey, Sr. | A43B 3/0026 62/51.1 |

(Continued)

*Primary Examiner* — Katharine G Kane

(74) *Attorney, Agent, or Firm* — Sterne, Kessler, Goldstein & Fox P.L.L.C.

(57) ABSTRACT

An article of footwear includes an upper and a sole coupled to the upper. The article of footwear includes a vacuum pump assembly. The vacuum pump assembly includes a flexible bladder and a pump disposed in the sole and in fluid communication with the bladder. The pump removes air from the bladder to draw a vacuum within the bladder. The pump includes a plunger that activates the pump in response to the application of force against the sole. The bladder constricts and conforms the upper against the wearer's foot as the pump removes air from the bladder to generate the vacuum.

9 Claims, 18 Drawing Sheets

(56) References Cited

U.S. PATENT DOCUMENTS 6,305,102 B1 * 10/2001 Doyle ..... A43B 13/206 36/71
7,047,670 B2 * 5/2006 Marvin ..... A43B 13/186 36/28
7,204,041 B1 * 4/2007 Bailey, Sr. ..... A43B 7/06 36/1
7,337,560 B2 * 3/2008 Marvin ..... A43B 13/20 36/50.1
7,478,488 B1 * 1/2009 Davis ..... A43B 23/029 36/3 A
7,513,067 B2 * 4/2009 Marvin ..... A43B 23/0255 36/88
9,687,045 B2 * 6/2017 Leary ..... A43B 7/1495
10,051,919 B2 8/2018 Leary et al.
10,251,450 B2 4/2019 Marvin et al.
2004/0003517 A1 * 1/2004 Marvin ..... A43B 13/20 36/29
2005/0003121 A1 * 1/2005 Koyanagi ..... A43B 13/203 428/34.1
2005/0281975 A1 * 12/2005 Huang ..... B32B 27/08 428/68
2006/0130369 A1 * 6/2006 Christensen ..... A43B 13/20 36/93
2012/0167413 A1 * 7/2012 Marvin ..... A43B 7/06 36/83
2016/0249706 A1 * 9/2016 Leary ..... A43B 23/22 36/93
2017/0348181 A1 * 12/2017 Perriard ..... A43B 5/00
2017/0360155 A1 * 12/2017 Leary ..... A43B 23/081
2018/0255865 A1 * 9/2018 Hsu ..... A43B 7/085
2019/0000186 A1 * 1/2019 Mou ..... A43B 23/029
2019/0053572 A1 * 2/2019 Patton ..... A43B 3/34
2019/0110557 A1 * 4/2019 Hobson ..... A43B 23/029
2019/0269202 A1 9/2019 Marvin et al.
2019/0365042 A1 * 12/2019 Weast ..... A43B 3/38
2020/0375319 A1 * 12/2020 Yang ..... A43C 11/008
2021/0244128 A1 * 8/2021 Costa ..... A43B 3/0036

* cited by examiner

VACUUM PUMP ASSEMBLY FOR ARTICLE OF FOOTWEAR

For purposes of 35 U.S.C. § 102 (c), a joint research agreement was executed between Reebok International Ltd. and Universal Trim Supply Co., Ltd relating to pump technologies applicable to footwear, apparel and accessories, and related to the manufacture or use of an air bladder which can be inflated or deflated.

BACKGROUND

Field of the Invention

The present disclosure relates to footwear, and more particularly relate to a vacuum pump assembly for an article of footwear.

Background

Articles of footwear typically include an upper and a sole, and are sold in a variety of sizes according to the length and width of the foot. However, even feet of similar length do not necessarily have the same geometry. Therefore, the upper may be adjustable to accommodate various foot contours. Such adjustment may include medial and lateral side portions which, when tensioned, provide support to the foot. In addition, the upper may include an ankle portion which encompasses a portion of the ankle region of the foot and thereby provides support thereto.

One common way to adjust the size of a shoe is through lacing. Lacing alone, however, suffers from several disadvantages, for example, when the shoe laces or strap is drawn too tightly, the fastening system can cause pressure on the instep of the foot. Such localized pressure is uncomfortable to the wearer and can make it difficult for the shoe to be worn for prolonged periods of time. Furthermore, while such fastening systems allow the upper of the shoe to be adjustable to accommodate varying foot and ankle configurations, they do not necessarily mold to the contour of individual feet. Moreover, regardless of how much tension is exerted on the medial and lateral side portion, there still remain areas of the foot which are not supported by the upper, due to the irregular contour of the foot. Avoiding displacements between the footwear and the foot results in less strain on the ankle and other parts of the foot.

Another attempt over the years to improve the fit and comfort of shoes is incorporating an inflatable bladder over the shoe's upper. The bladder is typically inflated by a pump. However, inflating the bladder via conventional inflation systems tends to push the bladder outwards away from the shoe upper, rather than constricting the bladder against the shoe's upper. Consequently, bladders inflated by conventional inflation systems can sometimes limit the ability to lock the wearer's foot against the upper, rendering a loose fit. Furthermore, conventional inflation systems typically include manual pumps that cannot automatically adjust the fit of the shoe during the course of activity.

Accordingly, there is a need for an improved closure system for an article of footwear that automatically allows a bladder to constrict and conform the article's upper against the wearer's foot, thereby providing a better fit with more efficiency.

BRIEF SUMMARY OF THE INVENTION

The present disclosure includes various embodiments of an article of footwear.

In accordance with one embodiment, an article of footwear comprises a sole; an upper coupled to the sole; a flexible bladder coupled to the upper; and a pump disposed in the sole and in fluid communication with the bladder. In some embodiments, the pump is configured to remove air from the bladder to generate a vacuum within the bladder. In some embodiments, the pump comprises a plunger configured to activate the pump to remove air from the bladder in response to an application of force against the sole. In some embodiments, as the pump removes air from the bladder to generate the vacuum, the bladder is configured to constrict and conform the upper against a wearer's foot.

In some embodiments, the sole comprises a midsole and an outsole coupled to a bottom of the midsole. In some embodiments, the midsole comprises a cavity, and the pump is disposed within the cavity of the midsole.

In some embodiments, the pump comprises an electronic actuator configured to reciprocate the plunger such that plunger activates the pump to remove air from the bladder.

In some embodiments, the article of footwear further comprises a deflection plate disposed in the cavity of midsole and flush along an upper surface of the midsole, the deflection plate securing the pump within the cavity of the midsole. In some embodiments, the pump is disposed in a heel region of the sole. In some embodiments, the pump is disposed in an arch region of the sole.

In some embodiments, the pump comprises a fitting defining a passage in fluid communication with the bladder, and a first valve disposed in the passage. In some embodiments, the first valve is biased at a closed position to seal the passage and configured to move to an open position to release air from the bladder through the passage.

In some embodiments, the pump further comprises a base coupled to the fitting. In some embodiments, the plunger is received on the base and configured to slide along the base between a first position and a second position. In some embodiments, the plunger is biased at the first position. In some embodiments, upon the application of force against the sole, the plunger is configured to slide along the base to the second position. In some embodiments, upon sliding along the base from the first position to the second position, the plunger is configured to force the first valve to move to the open position such that air is removed from the bladder.

In some embodiments, the plunger comprises a throat defining a slot aligned with the passage of the fitting and a second valve disposed in the slot of the throat, the second valve is biased at a closed position to seal the slot and configured to move to an open position to permit airflow through the slot. In some embodiments, when the plunger is set at the second position, the second valve moves to the open position releasing air from the passage of fitting through the slot of the throat.

In some embodiments, the base comprises a flange, and the plunger comprises a peripheral rim aligned with the flange of the base. In some embodiments, the pump comprises a plurality of springs received in the rim of the plunger and coupled to the flange of the base to bias plunger at the first position.

In accordance with an embodiment, an article of footwear comprises a sole; an upper coupled to the sole; a flexible bladder coupled to the upper and extending across a throat region from a lateral side to a medial side of the article of footwear, and a pump disposed in the sole and in fluid communication with the bladder. In some embodiments, the bladder comprising a plurality of channels. In some embodiments, the pump is configured to remove air from the bladder to generate a vacuum in each of the channels. In some embodiments, as the pump removes air from the bladder to generate the vacuum in the channels, the bladder is configured to constrict and conform the upper against a wearer's foot.

In some embodiments, the bladder comprises a first film of thermoplastic material and a second film of thermoplastic material coupled against portions of the first film to define the plurality of channels. In some embodiments, the bladder comprises an intermediate sheet of thermoplastic material disposed between the first film and second film.

In some embodiments, the plurality of channels are linear-shaped extending in a longitudinal direction along the article of footwear. In some embodiments, the plurality of channels are curved-shaped. In some embodiments, the plurality of channels define a pattern of geometric shapes.

In some embodiments, each of the channels comprise an upper portion defining an acute angle. In some embodiments, the plurality of channels comprise various heights in a range between 4 mm and 10 mm.

In some embodiments, the pump comprises a plunger configured to activate the pump to remove air from the bladder in response to an application of force against the sole. In some embodiments, the pump further comprises a base, a fitting extending through the base and defining a passage in fluid communication with the bladder, and a plurality of springs disposed between the base and the plunger. In some embodiments, the plurality of springs biases the plunger away from the base, and upon the application of force against the sole, the plunger is configured to overcome the bias of the plurality of springs and slide along the base such that the pump removes air from the bladder through the passage of the fitting.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

Figure 11A:
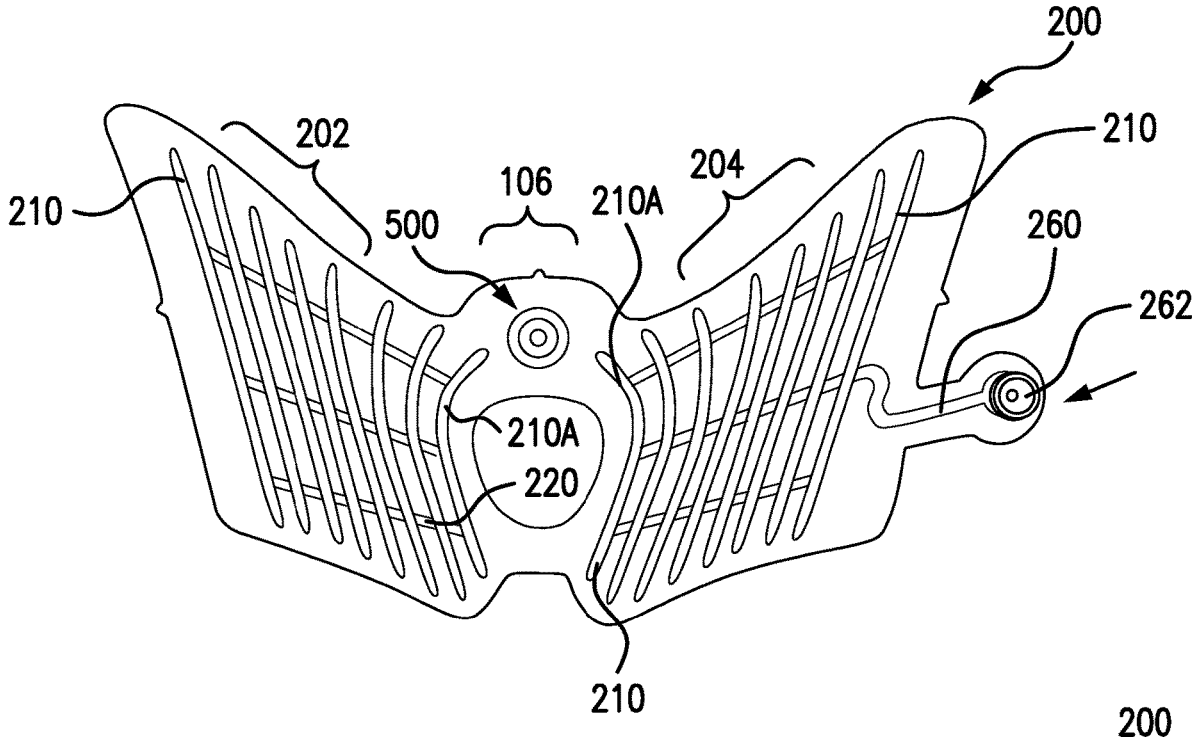
Figure 11B:
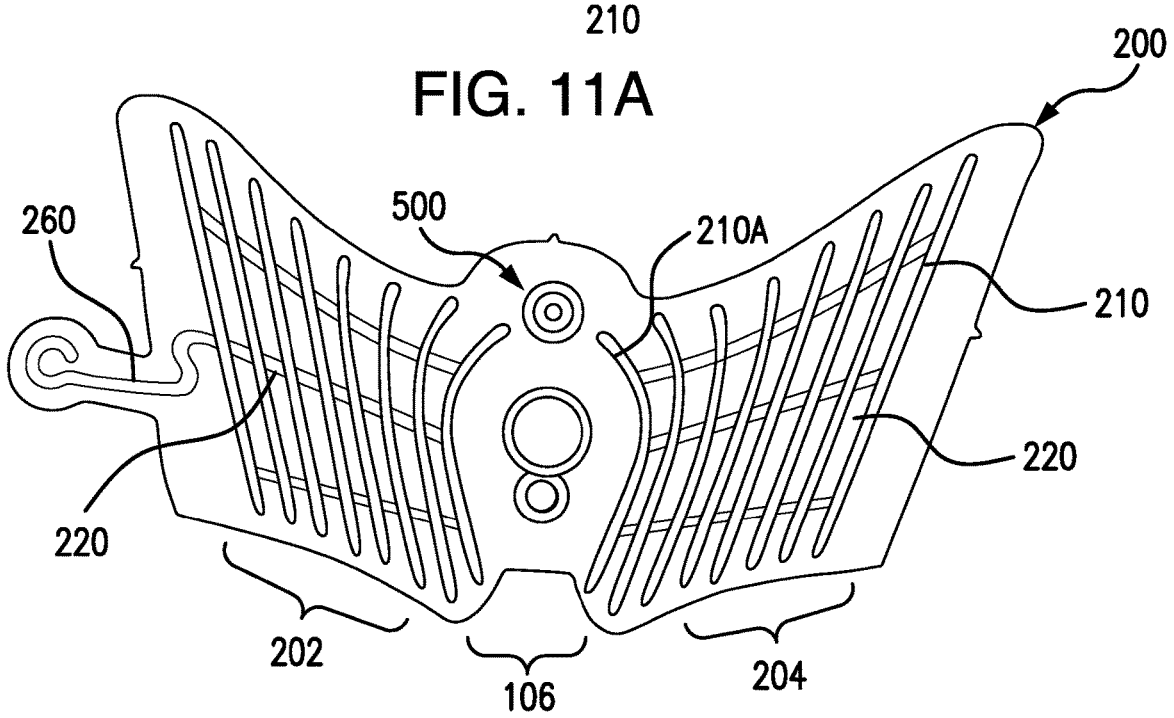

FIGS. 11A-B shows a top view of a first film and a second film of a bladder according to embodiments.

Figure 12B:
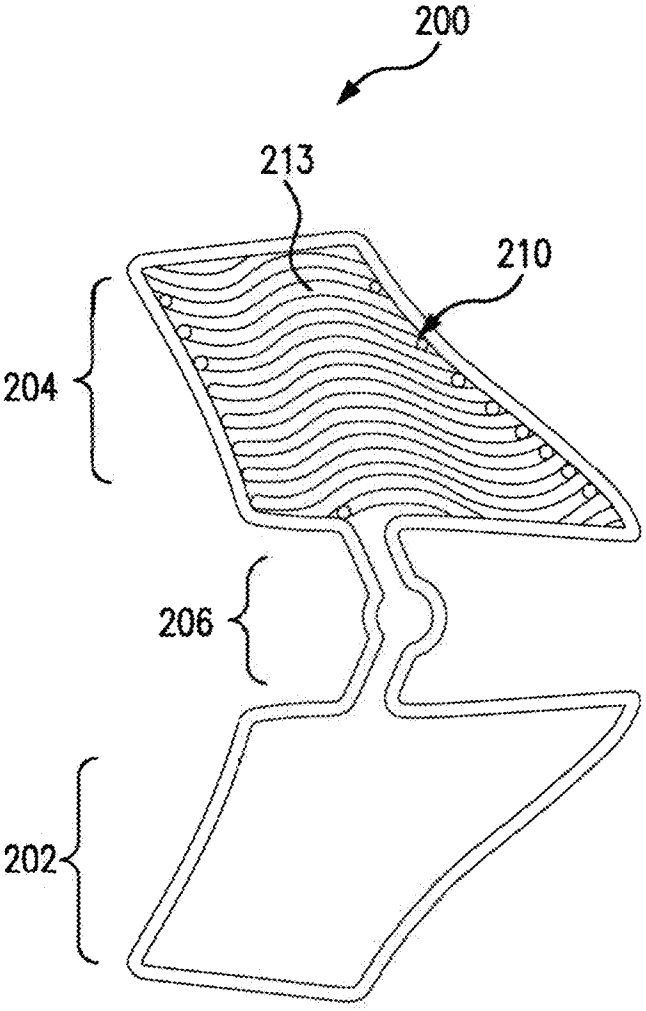
Figure 12A:
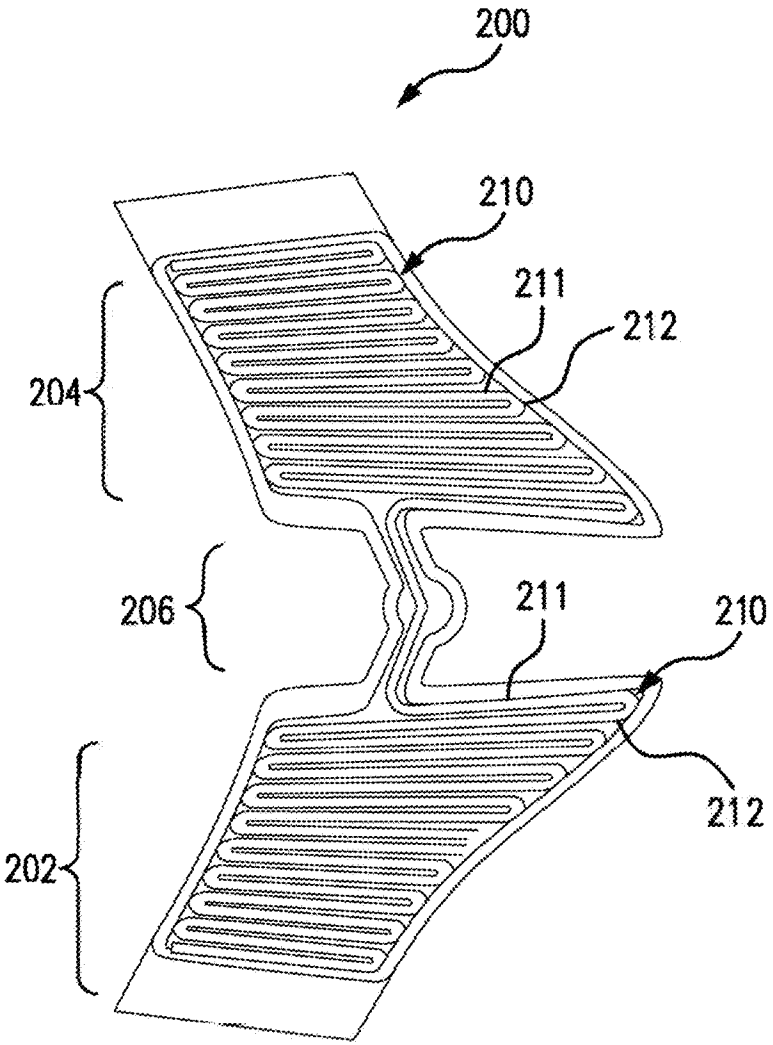

FIGS. 12A-B show a top view of a bladder according to embodiments.

Figure 13B:
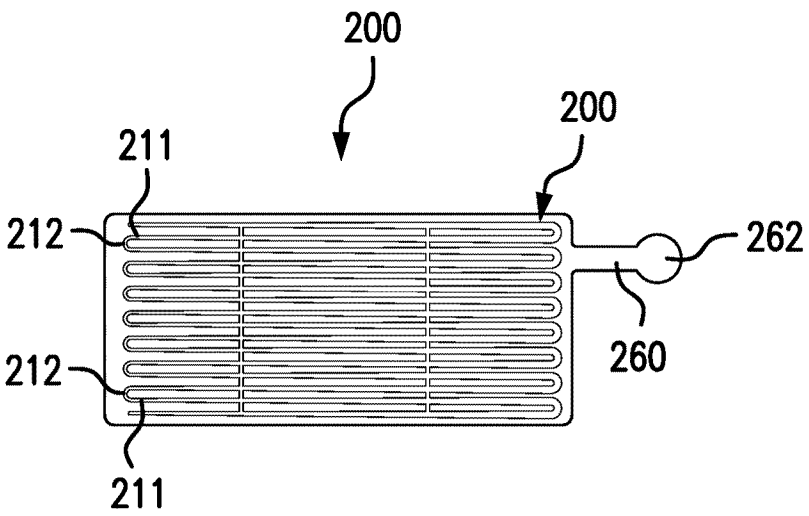
Figure 13A:
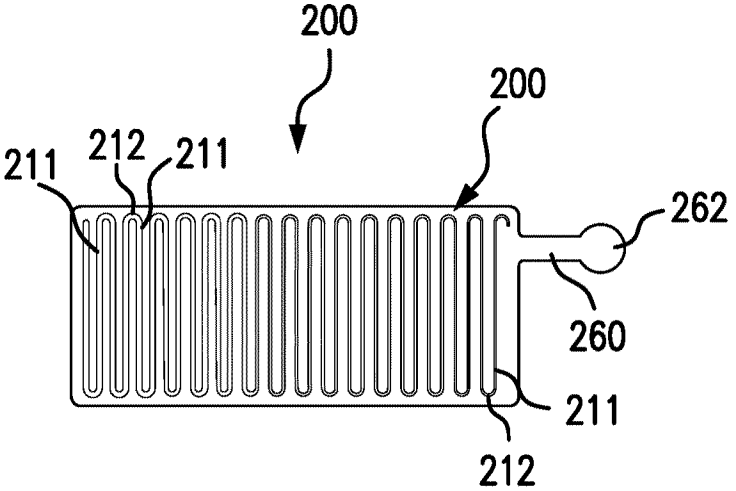
Figure 13C:
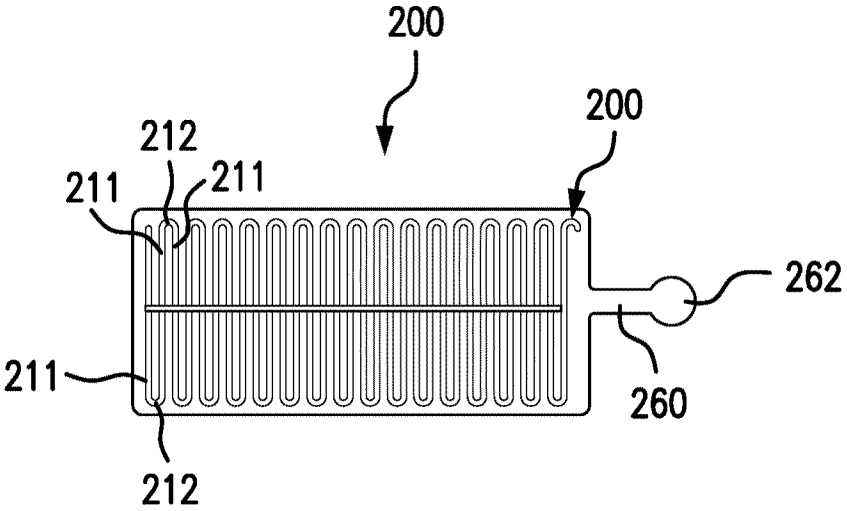

FIGS. 13A-C show a top view of a bladder according to embodiments.

Figure 14B:
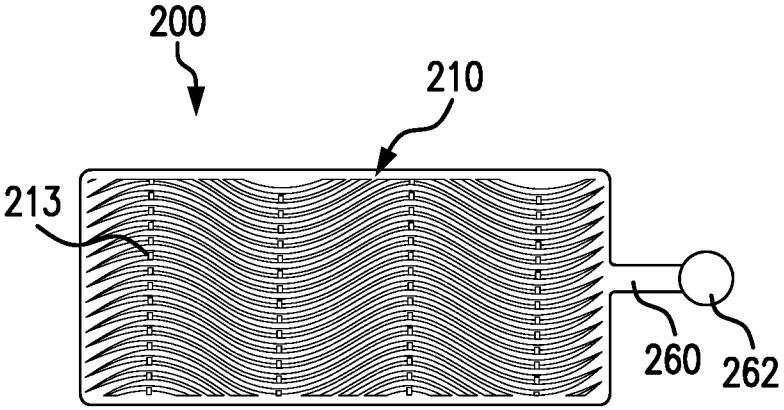
Figure 14A:
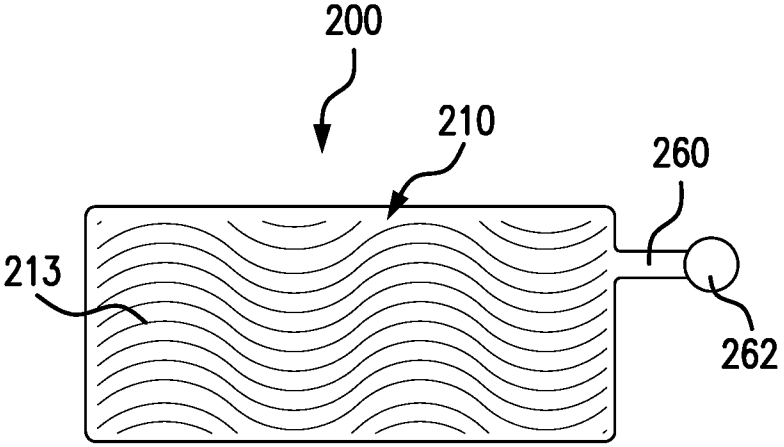
Figure 14C:
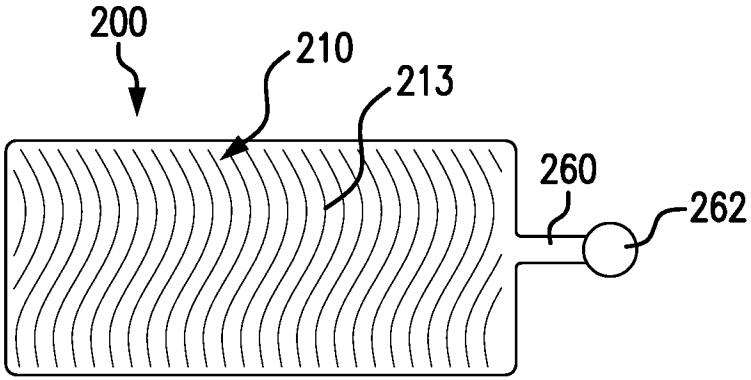

FIGS. 14A-C show a top view of a bladder according to embodiments.

FIGS. 15A-F show a top view of a bladder according to embodiments.

Figure 16A:
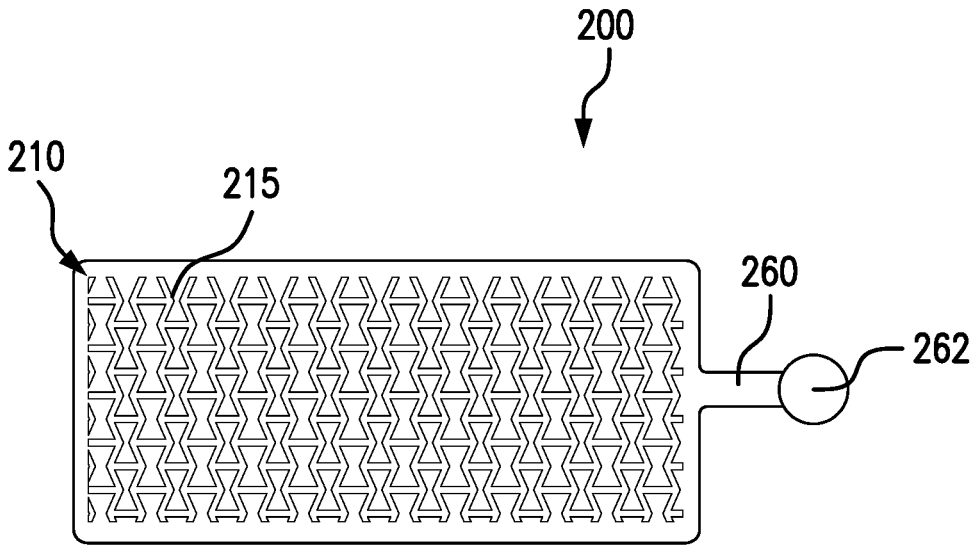
Figure 16B:
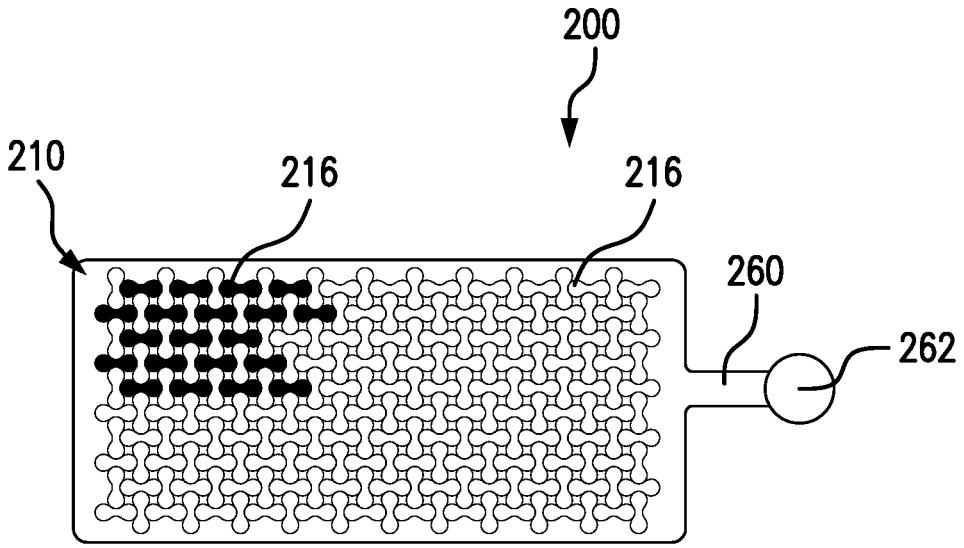

FIGS. 16A-B show a top view of a bladder according to embodiments.

DETAILED DESCRIPTION OF THE INVENTION

The present inventions will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present inventions. Other suitable modifications and adaptations of the variety of conditions and parameters normally encountered in the field, and which would be apparent to those skilled in the art, are within the spirit and scope of the inventions.

It is typically desirable for athletic shoes to provide a tight fit to the wearer's foot when engaged during an athletic activity, such as running or jogging. To provide a tight fit between a shoe's upper and the wearer's foot, conventional shoes include laces, straps, or zippers as closure system to adjust the fit of the shoe. However, manually adjusting the fit of the shoe through laces, straps, or zippers can be cumbersome. Moreover, conventional closure systems fail to continuously adjust the fit of the shoe during activity. Accordingly, as the wearer engages in an athletic activity, the fit of the shoe may unwantedly loosen over the course of activity.

One attempt over the years to improve the fit and comfort of shoes is incorporating an inflatable bladder over the shoe's upper. The bladder is typically inflated by a pump. However, inflating the bladder via conventional inflation systems tends to push the bladder outwards away from the shoe upper, rather than constricting the bladder against the shoe's upper. Consequently, bladders inflated by conventional inflation systems can sometimes limit the ability to lock the wearer's foot against the upper, rendering a loose fit. Furthermore, conventional inflation systems typically include manual pumps that cannot automatically adjust the fit of the shoe during the course of activity.

Accordingly, there is a need for an improved vacuum pump assembly for an article of footwear that automatically allows the inflatable bladder to constrict and conform the article's upper against the wearer's foot, thereby providing a better fit with more efficiency.

According to various embodiments described herein, the article of footwear of the present disclosure may overcome one or more of the deficiencies noted above by comprising a sole, an upper coupled to the sole, and a vacuum pump assembly. In some embodiments, the vacuum pump assembly may include a flexible bladder coupled to the upper, a pump disposed in the sole and in fluid communication with the bladder, and an actuator disposed in the sole. In some embodiments, the pump may be configured to remove air from the bladder to generate a vacuum within the bladder. In some embodiments, the actuator may be configured to activate the pump in response to the application of force against the sole (e.g., force applied to bottom of sole during wearer's gait cycle). In some embodiments, the bladder may be configured to constrict and conform the upper against a wearer's foot as the pump removes air from the bladder to generate the vacuum.

Figure 1:
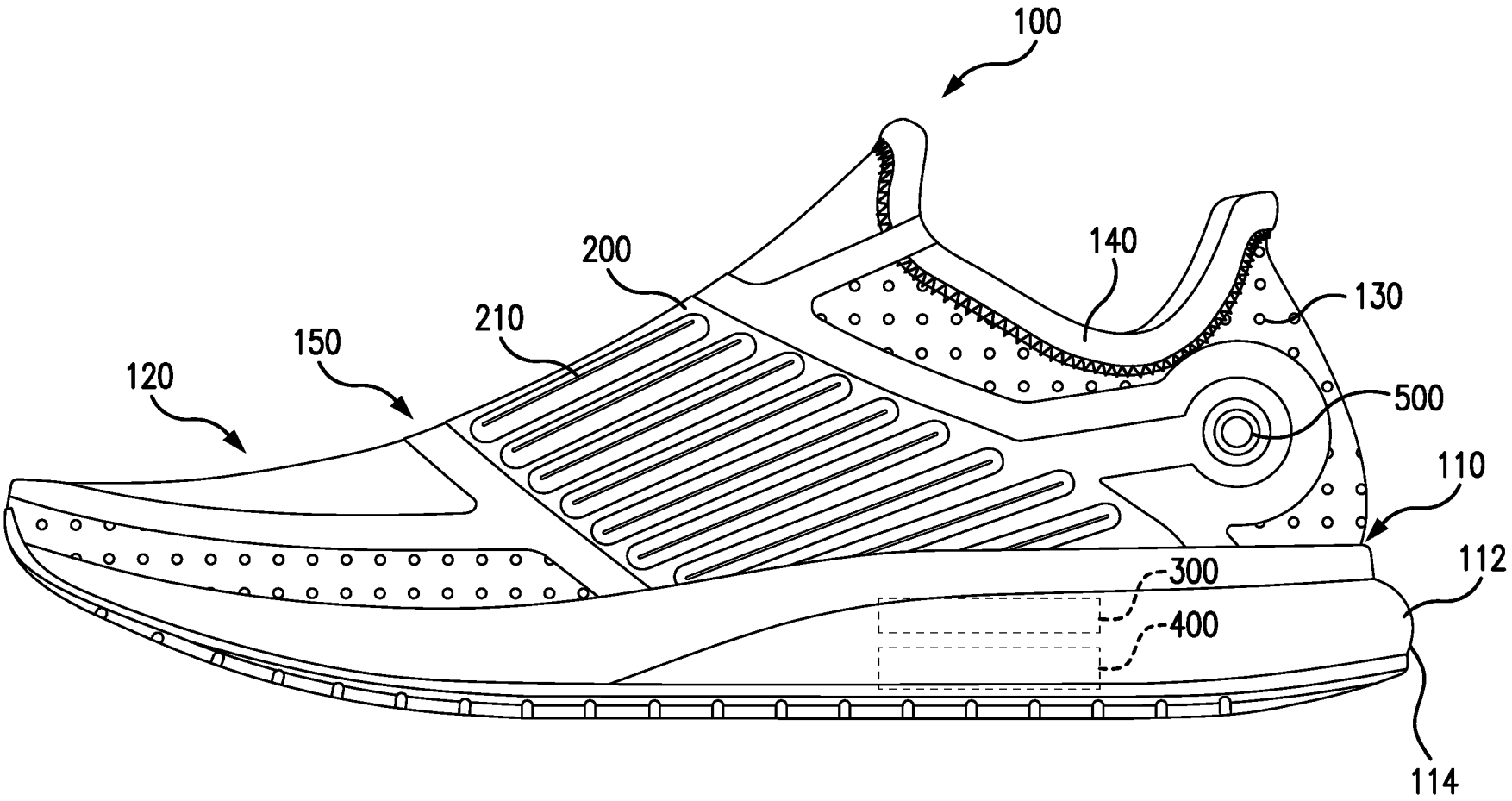
FIG. 1 shows an isolation lateral side view of an article of footwear according to embodiments.

An athletic shoe 100, as illustrated, for example, in FIG. 1, is an embodiment of the article of footwear. Athletic shoe 100 may comprise a running shoe, a training shoe, a basketball shoe, or any other suitable athletic shoe. Although athletic shoe 100 is primarily described, other embodiments envision the present invention utilized in other types of footwear, including, but not limited to, non-athletic footwear, and sandals.

In various embodiments, athletic shoe 100 may include a heel region 101, a midfoot or arch region 102, and a forefoot region 103 extending between a lateral side 104 and a medial side 105 of athletic shoe 100. In various embodiments, as shown in FIG. 1, for example, athletic shoe 100 may include a sole 110 and an upper 120 coupled to sole 110.

In various embodiments, sole 110 may have various characteristics, such as absorbing shock, protecting a wearer's foot, and providing traction with each foot strike. In some embodiments, as shown in FIG. 1, for example, sole 100 may include an outsole 114, a midsole 112, and an insole or sockliner. In some embodiments, sole 110 may be constructed of any materials suitable for absorbing shock and providing cushion. In some embodiments, the materials used for the outsole 114, midsole 112, and an insole may be different from each other or the same. In some embodiments, for example, the outsole 114 may comprise a material that is abrasion resistant, such as rubber. In some embodiments, midsole 112 may be comprised of a foam-based material, such as ethyl vinyl acetate (EVA) foam or foamed polyurethane.

In various embodiments, upper 120 may be configured to receive and surround a wearer's foot when disposed on sole 110. In some embodiments, upper 120 may be attached to sole 110 by stitching, an adhesive, or other suitable fasteners. In some embodiments, upper 120 may include one or more flexible layers 130. In some embodiments, flexible layer 130 may be comprised of a flexible material. In some embodiments, flexible layer 130 may be comprised of a stretchable textile with multi-dimensional stretch. In some embodiments, flexible layer 130 may include a fabric comprising Lycra®. In some embodiments, flexible layer 130 may be comprised of a mesh material.

In some embodiments, each flexible layer 130 may be made from the same material. In some embodiments, one flexible layer 130 may be made from a different material than another flexible layer 130. In some embodiments, each flexible layer 130 has the same properties. In some embodiments, one flexible layer 130 may have different properties than another flexible layer 130 (e.g., flexible layer 130 closest to the wearer's foot may have a finer mesh than flexible layer 130 visible from outside of the upper 120). In some embodiments, flexible layer 130 may have different properties in different regions of upper 120 (e.g., finer mesh in a heel region than in a vamp region).

In some embodiments, upper 120 may include a collar 140 that defines an opening for receiving the wearer's foot within upper 120. In some embodiments, upper 120 may include a toe cap to provide additional support and protection to the wearer's foot in the toe region. In some embodiments, upper 120 may include a heel counter to provide additional support and protection to the wearer's foot in the heel region.

In various embodiments, athletic shoe 100 may include a vacuum pump assembly 150 that automatically adjusts the support and fit provided by athletic shoe 100 while the wearer is engaged in an athletic activity, such as running, walking, jumping, etc. In some embodiments, vacuum pump assembly 150 may include a bladder 200 for securing upper 120 against the wearer's foot. In some embodiments, vacuum pump assembly 150 may include a pump 300 for automatically removing air from bladder 200 during a wearer's gait cycle. In some embodiments, vacuum pump assembly 150 may include an actuator 400 for reinforcing actuation of a pump 300 during a wearer's gait cycle. By removing air from bladder 200 during the wearer's gait cycle, vacuum pump assembly 150 advantageously secures the wearer's foot in shoe 100 and reduces heel slip, without requiring manual adjustment of the air pressure within bladder 200.

In some embodiments, as shown in FIGS. 11A-B, for example, vacuum pump assembly 150 may further include a release valve 500 disposed on bladder 200. In some embodiments, release valve 500 may be configured to dump air out of bladder 200. In some embodiments, as shown in FIG. 11B, for example, vacuum pump assembly 150 may further include an inflation pump 600 disposed on bladder 200. In some embodiments, inflation pump 600 may be configured to pump air into bladder 200. In some embodiments, inflation pump 600 is an inflation mechanism as disclosed in commonly owned U.S. Pat. No. 5,435,230, entitled "Inflation Mechanism," the disclosure of which in its entirety is incorporated by reference.

A. Bladder

In some embodiments, bladder 200 may be disposed on any portion of upper 120 so that bladder 200 secures the wearer's foot in athletic shoe 100 and reduces heel slip, for example, by cinching down on the wearer's foot. In some embodiments, bladder 200 draws flexible layer 130 toward the wearer's foot when bladder 200 may be deflated such that bladder 200 may tighten flexible layer 130 around the wearer's foot. By securing the wearer's foot in shoe 100, bladder 200 eliminates the need for other closure systems, such as laces, zippers, and hook-and-loop fastener.

In some embodiments, bladder 200 may be disposed on an outermost surface of upper 120. In some embodiments, bladder 200 may be disposed on an outer surface of flexible layer 130. In some embodiments, inflatable bladder 200 may be attached to upper 120 (e.g., flexible layer 130) by stitching, adhesive, bonding, heat sealing, or other suitable fastening method. For example, bladder 200 may be hot melted to flexible layer 130 with an adhesive such that the adhesive forms a layer between flexible layer 130 and bladder 200. In some embodiments, adhesive may include, for example, an ethylene-vinyl acetate copolymer, a polyolefin, a polyamide, a polyester, a polyurethane, or other suitable adhesive. In some embodiments, inflatable bladder 200 may be attached to upper 120 by other methods, such as, for example, RF welding, sonic welding, heat sealing, or other mechanical means.

In some embodiments, bladder 200 may extend from lateral side 104 in a heel region 101 and midfoot region 102 across a throat region 106 (e.g., a tongue portion of shoe 100) to medial side 105 in heel region 101 and midfoot region 102 of athletic shoe 100. In some embodiments, as shown in FIGS. 11 and 12, for example, bladder 200 may include a plurality of compartments 202, 204. In some embodiments, bladder 200 may include a medial compartment 202 disposed along upper 120 on medial side 105 of shoe 100 and a lateral compartment 204 disposed along upper 120 on lateral side 10. In some embodiments, medial compartment 202 and lateral compartment 204 may be contiguously connected together such that bladder 200 wraps over upper 120 from lateral side 104 to medial side 105 as one piece. In some embodiments, as shown in FIGS. 12A-B, for example, medial compartment 202 and lateral compartment 204 may be connected together by a junction 206 (e.g., stretchable piece of fabric) located in throat region 106 of shoe 100. In some embodiments, bladder 200 may include additional compartments, including a heel compartment and a tongue compartment. In some embodiments, bladder 200 may be comprised only of a tongue compartment overlying throat region 106 of shoe 100.

In various embodiments, bladder 200 may be comprised of a flexible material such that bladder 200 may expand with air supply and constrict with air removal to adjust fit and support provided by athletic shoe 100. In some embodiments, bladder 200 may be comprised of two or more films joined together to enclose a plurality of channels 210, cross-channels 220, or a reservoir for storing a fluid and holding a vacuum. In some embodiments, the plurality of channels 210 may define an outer corrugated surface along the joined films of bladder 200, thereby promoting airflow out of channels 210 as pump 300 removes air from the bladder 200. In some embodiments, each film may be comprised of at least one layer (e.g., a multi-layer film package) of a thermoplastic polymer or co-polymer material, such as thermoplastic elastomer, polyurethane, polyethylene, polypropylene, neoprene, polyvinylchloride, nitrile rubber, ethylene vinyl acetate, or a combination thereof. In some embodiments, each film can be further laminated or otherwise bonded to a stretchable textile substrate.

In some embodiments, as shown in FIGS. bladder 200 may include a first film comprised of a thermoplastic material and a second film of a thermoplastic material that is coextensive with the first film. The first film may be coupled to selected portions of the second film through an attachment process. For example, high radio frequency (r.f.) welding may be used to secure selected portions of the first film to the second film. A gap may be provided between the remaining portions of the first and second films to introduce air or hold a vacuum between the first and second films.

In some embodiments, each of the first and second films may be a single layer film or a composite of two or more films. In some embodiments, each of the first and second films may include an individual thickness in a range between 0.1 mm and 1.2 mm. The material selection for the first and second films may be set to provide a hardness in a range between 75A and 95A shore A. In some embodiments, bladder 200 may include an intermediate sheet of thermoplastic material disposed between the first and second films to prevent sticking.

Figure 4:
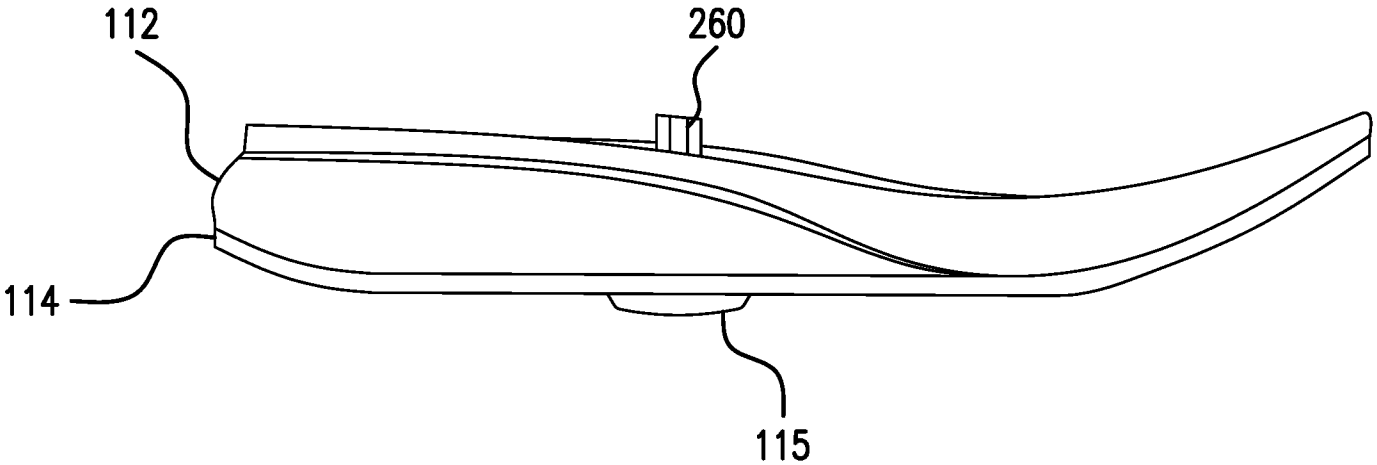
FIG. 4 shows a medial side view of a sole with a vacuum pump assembly according to embodiments.
Figure 5A:
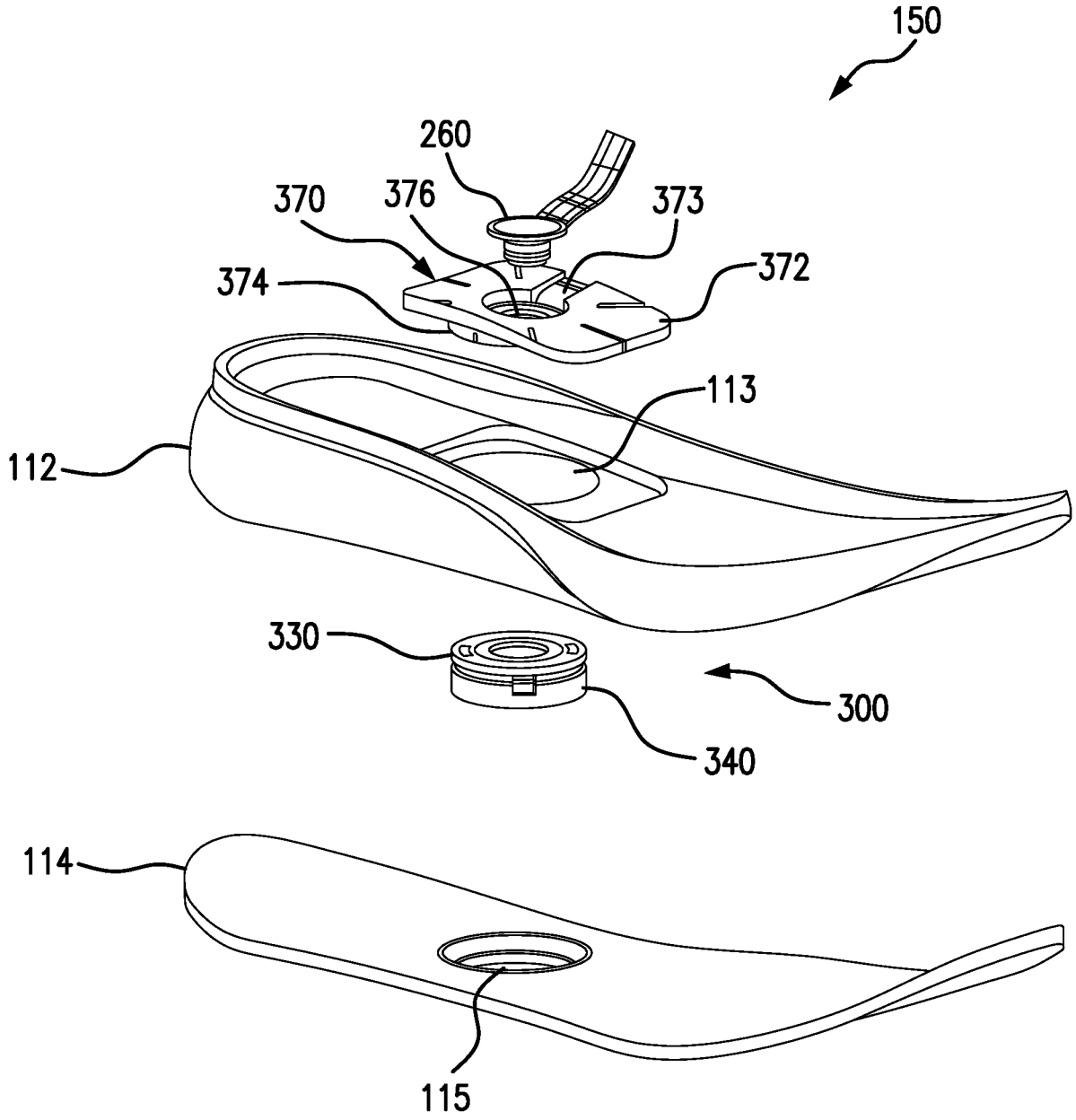
FIG. 5A shows an exploded view of a sole with a vacuum pump assembly according to embodiments.
Figure 5B:
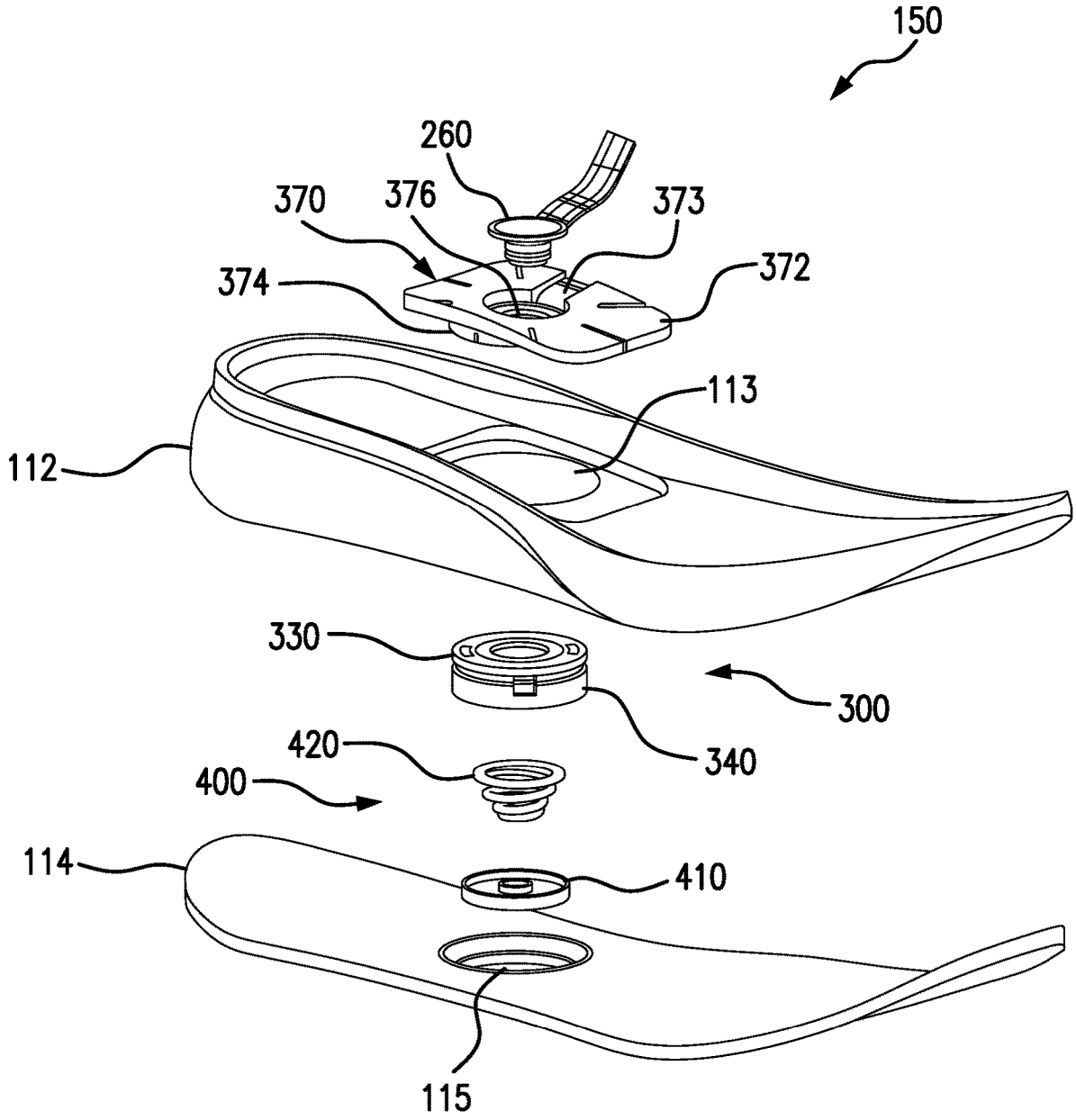
FIG. 5B shows an exploded view of a sole with a vacuum pump assembly according to embodiments.

In some embodiments, as shown in FIGS. 4 and 5, for example bladder 200 may include a connector conduit 260 that defines an air passage fluidly connecting bladder 200 to pump 300. In some embodiments, connector conduit 260 may be formed from two or more polymer sheets joined together to define an air passage there between. In some embodiments, the polymer films may include a thermoplastic polyurethane sheet, mesh-based sheet, or a combination thereof. In some embodiments, connector conduit 260 may be disposed only on the medial side of athletic shoe 100. In some embodiments, connector conduit 260 may be disposed only on the lateral side of athletic shoe 100. In some embodiments, connector conduit 260 may be disposed on both the lateral and medial side of athletic shoe 100.

In various embodiments, the shape and dimensions of channels 210 may be configured to promote the compressibility of bladder 200. In some embodiments, each channel 210 includes an upper boundary portion disposed along the cross section of channel 210 that defines an acute angle. The acute-angle defined by the upper boundary portion guides the constriction of channel 210 so that bladder 200 clasps upper 120 against the wearer's foot. In some embodiments, channels 210 may include a height in a range between 4 mm and 10 mm. In some embodiments, the height of channels 210 may be uniform height along the entire length of channels 210. In some embodiments, the height of channels 210 may vary along the length of channels 210.

In various embodiments, as shown in FIGS. 1, 11, 13A-C, 14A-C, 15A-F, and 16A-B, for example, channels 210 may be arranged along bladder 200 to define a pattern of geometric shapes that promotes the compressibility of the bladder 200. In some embodiments, the arrangement of channels 210 along bladder 200 may define auxetic-structural patterns. By defining an auxetic-structural pattern, channels 210 allow bladder 200 to expand in a direction transverse to a direction of applied strain. (e.g., the strain applied by the generated vacuum held within bladder 200). Expanding in a direction transverse to the direction of applied strain, bladder 200 may be configured to constrict around the wearer's foot tightly as air is removed from channels 210 via pump 300.

In some embodiments, as shown in FIGS. 1 and 11A-B, for example, bladder 200 may include linear-shaped channels 210 extending in a longitudinal direction along shoe 100. In some embodiments, as shown in FIG. 1, for example, linear-shaped channels 210 may extend parallel with each other. In some embodiments, as shown in FIG. 11A-B, for example, one or more of linear-shaped channels 210 disposed proximate to throat region 106 of shoe 100 may include curved portions 210A, and one or more of linear-shaped channels 210 disposed proximate to lateral and medial edge of shoe 100 extend substantially straight along the entire length of channel 210. In some embodiments, as shown in FIG. 11A-B, bladder 200 may include one or more cross-channels 220 extending transverse to channels 210 such that cross-channels 220 fluidly connect multiple channels 210.

In some embodiments, as shown in FIGS. 12A and 13A-C, for example, channels 210 may define a serpentine pattern, in which channels 210 include a linear segment 211 and a curved segment 212 connected to an end of linear segments 211. In some embodiments, as shown in FIGS. 12 and 13C, for example, the width of linear segments 211 and curved segments 212 of channels 210 may be uniform along the length of bladder 200. In some embodiments, as shown in FIGS. 13A-B, for example, the width of linear segments 211 and curved segments 212 of channels 210 may vary along the length of bladder 200. In some embodiments, as shown in FIG. 13A, for example, linear segments 211 of channels 210 may extend transverse to the longitudinal direction of bladder 200. In some embodiments, as shown in FIG. 13B, linear segments 211 of channels 210 may extend parallel to the longitudinal direction of bladder 200.

In some embodiments, as shown in FIGS. 12B and 14A-C, for example, bladder 200 may include curved-shaped channels 210. In some embodiments, curved-shaped channels 210 may define a sinusoidal curve 213 extending across the length of bladder 200. In some embodiments, curved-shaped channels 210 may extend parallel to each other along the length of bladder 200. In some embodiments, as shown in FIGS. 12B, 14A, and 14C, for example, the width of curved-shaped channels 210 may be uniform along the length of bladder 200. In some embodiments, as shown in FIG. 14B, for example, the width of curved-shaped channels 210 may vary along the length of bladder 200.

Figure 15A:
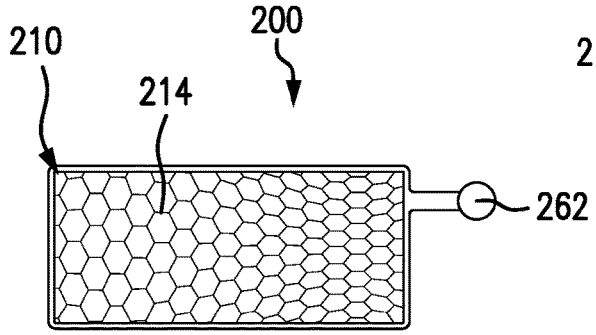
Figure 15B:
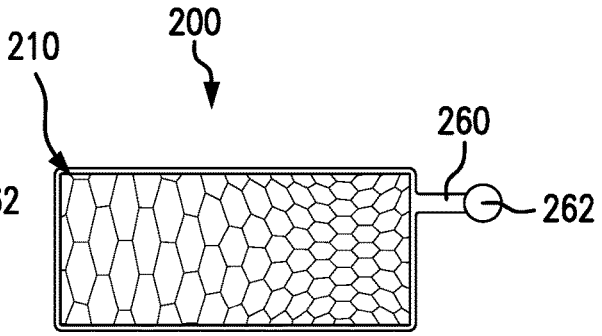
Figure 15C:
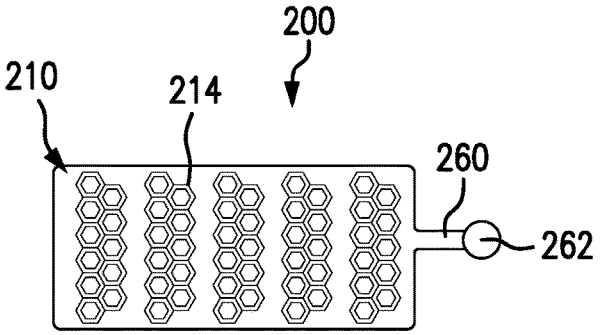
Figure 15D:
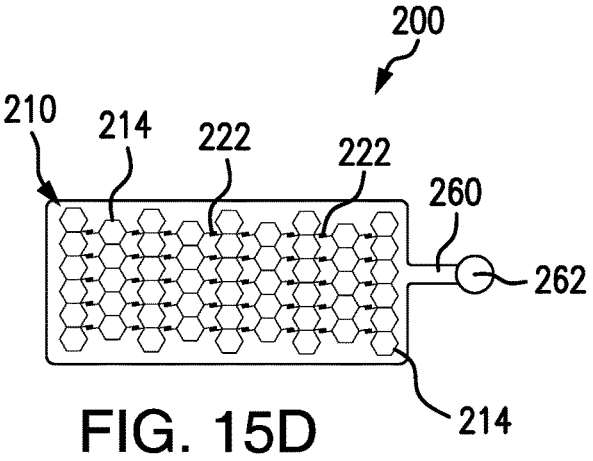
Figure 15E:
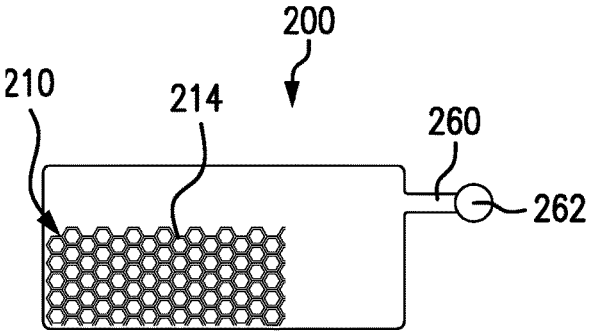
Figure 15F:
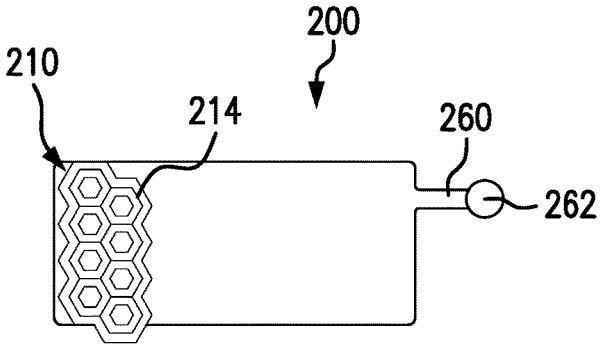

In some embodiments, as shown in FIGS. 15A-F, for example, bladder 200 may include channels 210 arranged to define a honeycomb pattern comprised of a plurality of convex hexagonal prisms 214. In the context of the present disclosure, a convex hexagon is a six-sided polygon that does not include any internal angles being greater than 180°. In some embodiments, as shown in FIGS. 15C-F, for example, the dimensions (e.g., width, perimeter, etc.) of hexagonal prisms 214 defined by channels 210 may be uniform along the length of bladder 200. In some embodiments, as shown in FIGS. 15A-B, for example, the dimensions of hexagonal prisms 214 defined by channels 210 may vary along the length of bladder 200. In some embodiments, as shown in FIG. 15D, for example, bladder 200 may include a plurality of connector channels 222 fluidly connecting channels 210 of adjacent hexagonal prisms 214. In some embodiments, as shown in FIGS. 15C, 15E, and 15F, for example, hexagonal prisms 214 defined by channels 210 may be disposed along only selected portions of bladder 210, whereas remaining portions of bladder 200 do not include any channels 210.

In some embodiments, as shown in FIGS. 16A-B, for example, bladder 200 may include channels 210 arranged to form a tessellation of geometric shapes such that channels 210 comprise a greater percentage of the surface area of bladder 200. In the context of the present disclosure, a tessellation is an arrangement of shapes closely fitted together such that there are no gaps between adjacent shapes. In some embodiments, as shown in FIG. 16A, for example, bladder 200 may include channels 210 arranged to define a tessellated pattern comprised of a plurality of concave hexagonal prisms 215. In the context of the present disclosure, a concave hexagon is a six-sided polygon that includes at least one internal angle being greater than 180°. In some embodiments, as shown in FIG. 16B, for example, bladder 200 may include channels 210 arranged to define a tessellated pattern comprised of a plurality of closed curves 216.

While bladder 200 is primarily discussed as a single bladder, in some embodiments, bladder 200 may include multiple bladders disposed on upper 120. In some embodiments, the multiple chambers of bladder 200 may be connected by one or more air passages.

B. Pump

Figure 2:
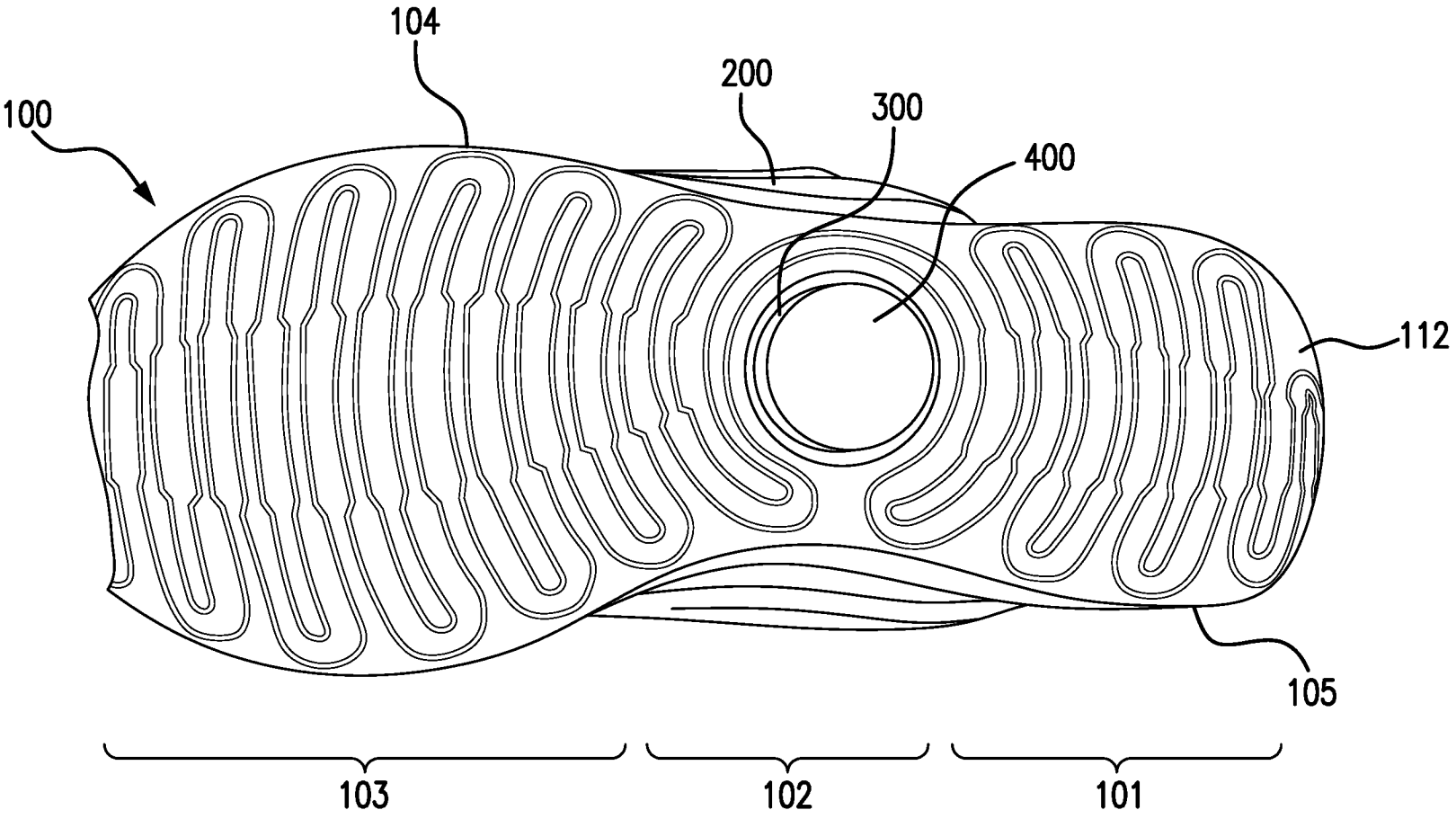
FIG. 2 shows a bottom view of an article of footwear according to embodiments.
Figure 3:
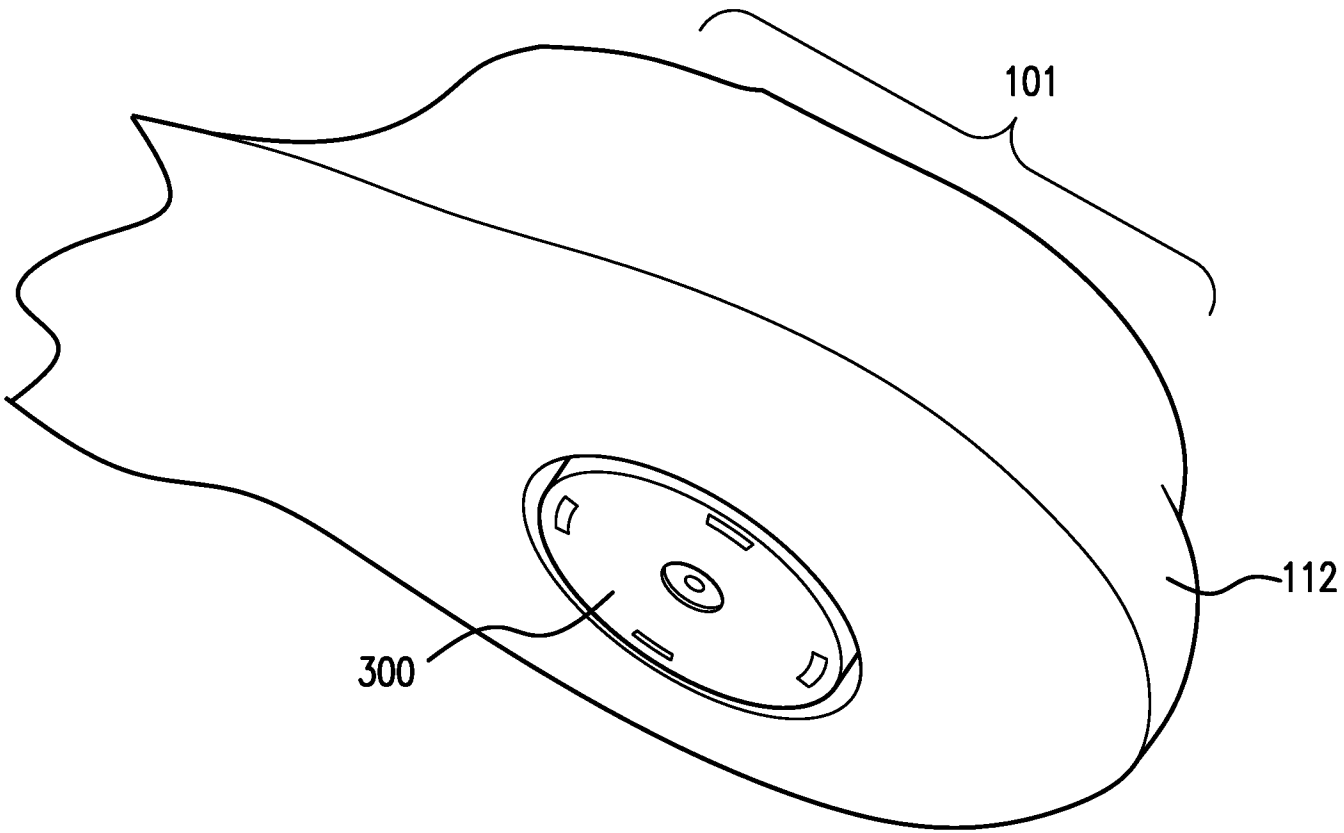
FIG. 3 shows a bottom view of an article of footwear according to embodiments.

In various embodiments, pump 300 may be disposed in sole 110 and in fluid communication with bladder 200. In some embodiments, as shown in FIG. 2, for example, pump 300 may be disposed within a cavity 113 of midsole 112 located along midfoot region 102 of athletic shoe 100. In some embodiments, as shown in FIG. 3, for example, pump 300 may be disposed within a cavity 113 of midsole 112 located along heel region 101 of athletic shoe 100. In some embodiments, pump 300 may be centrally located between medial and lateral sides of shoe 100. In some embodiments, pump 300 may be disposed adjacent to one of the medial and lateral sides of shoe 100. In some embodiments, pump 300 may be located in forefoot region 103 of athletic shoe 100. In some embodiments, pump 300 may be located partially in forefoot region 103 and partially in midfoot region 102 of athletic shoe 100.

Figure 8:
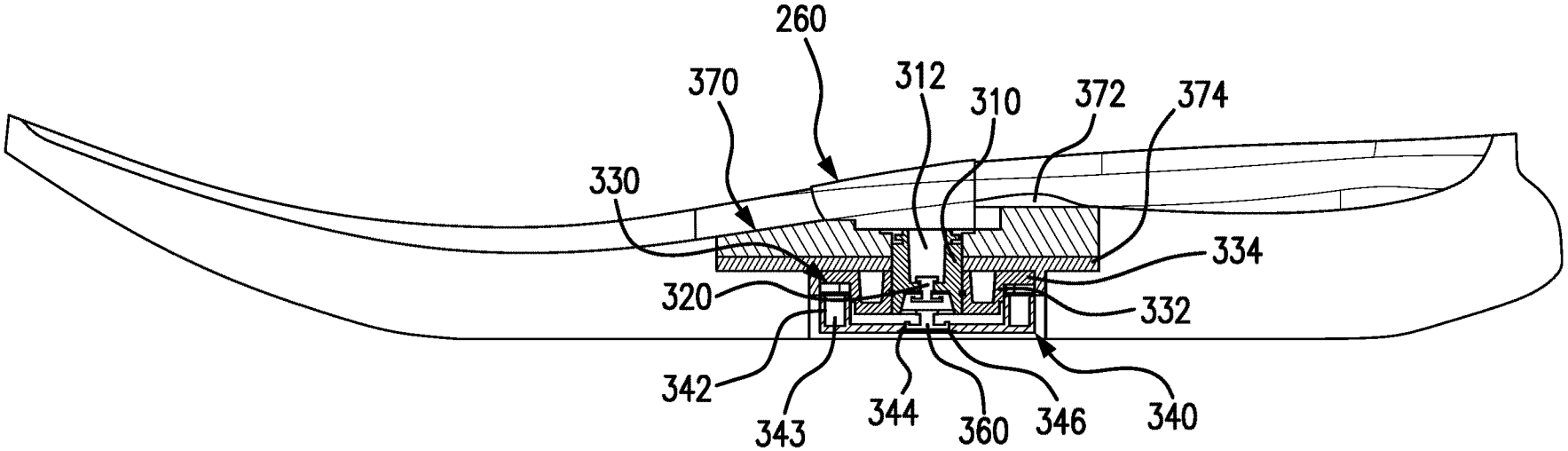
FIG. 8 shows a longitudinal side cross-section view of a sole with a vacuum pump assembly according to embodiments.

In some embodiments, as shown in FIGS. 5-8, for example, pump assembly 150 may include a deflection plate 370 disposed in midsole 112 to secure pump 300 within cavity 113 and connector conduit 260 to pump 300. In some embodiments, deflection plate 370 may include a first portion 372 disposed flush along an upper surface 112A of midsole 112. In some embodiments, deflection plate 370 may include a second portion 374 projecting from first portion 372 and disposed in cavity 113 of midsole 112. In some embodiments, as shown in FIG. 6A, for example, first portion 372 and second portion 374 of deflection plate 370 are comprised as a single piece of material. In some embodiments, as shown in FIG. 8, for example, first portion 372 and second portion 374 of deflection plate 370 are comprised of separate materials integrated together. In some embodiments, deflection plate 370 may include a through-hole 376 opening through both first portion 372 and second portion 374 and into cavity 113. In some embodiments, deflection plate 370 may include a groove 373 disposed along first portion 372 and opening into through-hole 376. In some embodiments, connector conduit 260 may be received in groove 373 and may include a port 262 covering through-hole 376.

In various embodiments, pump 300 may be configured to remove air from bladder 200. In various embodiments, repetitive actuation of pump 300 may allow pump 300 to remove substantially the entire volume of air held in channels 210 of bladder 200 to generate a vacuum therein. In various embodiments, pump 300 may include a combination of one or more valves, fittings, and reciprocating or rotary members (e.g., plunger, piston, diaphragm, impeller, etc.) operatively connected together to remove air from bladder 200.

Figure 6A:
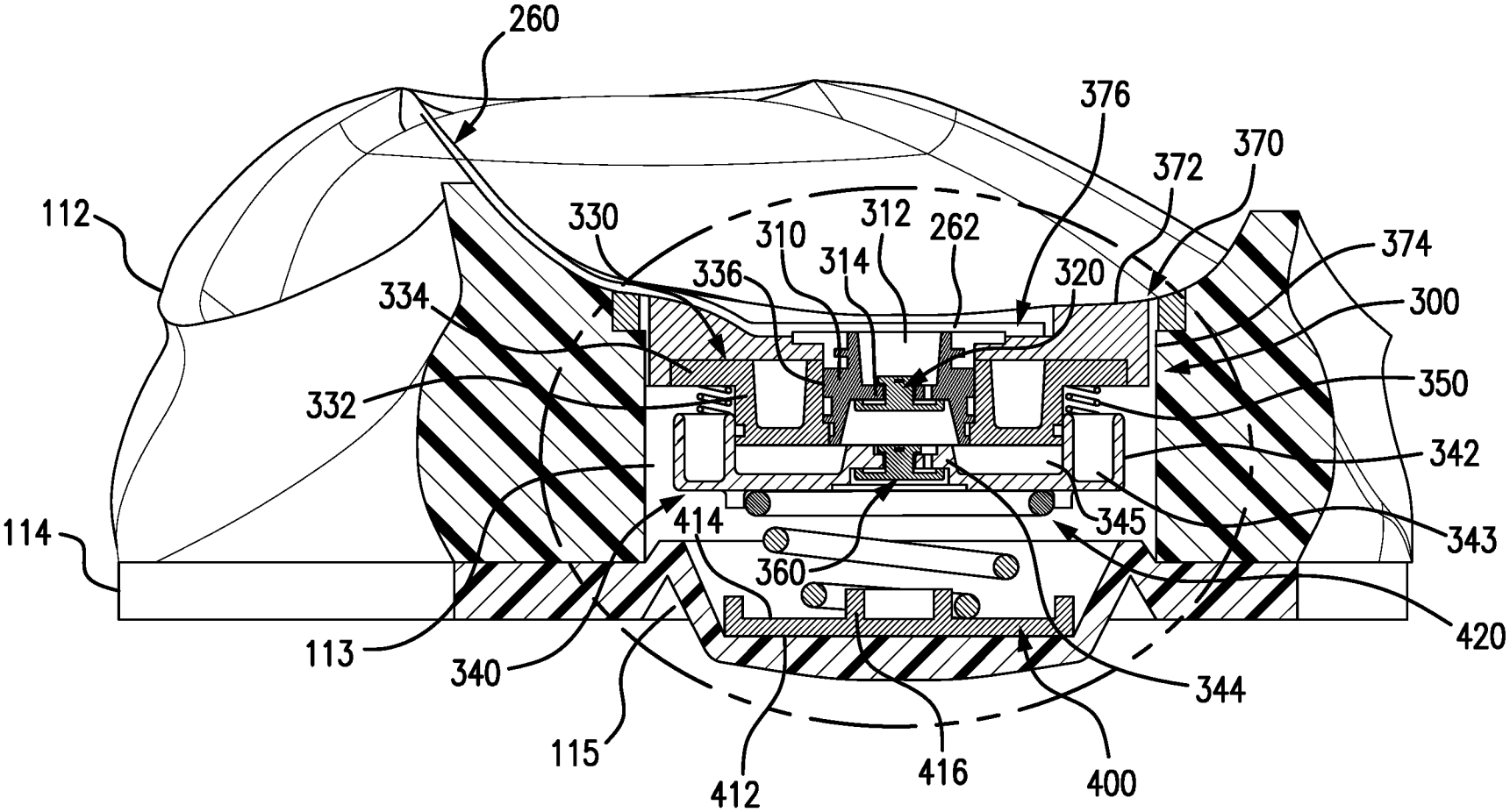
FIG. 6A shows a lateral cross-sectional view of the sole taken along line A-A in FIG. 4 according to embodiments.
Figure 6B:
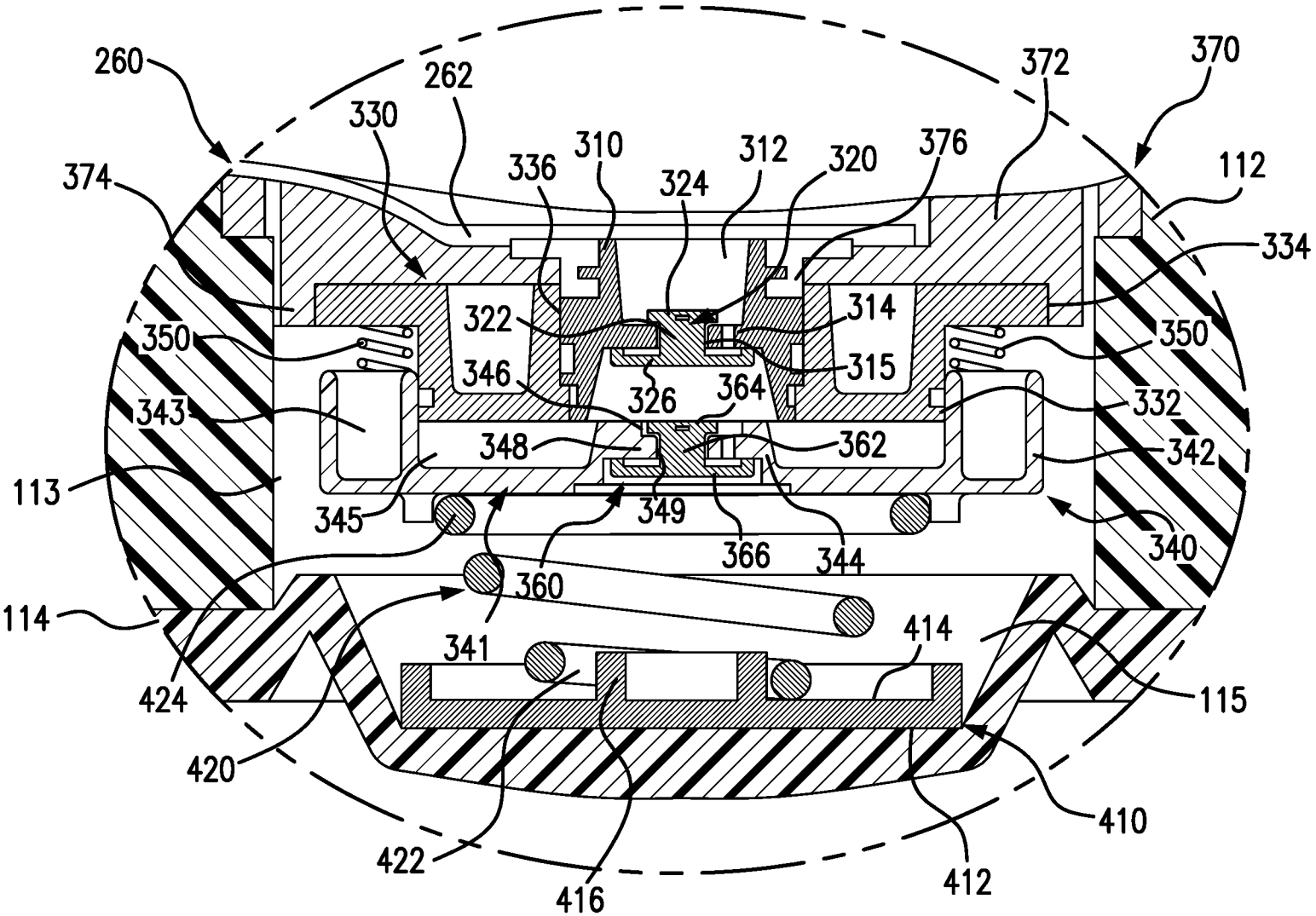
FIG. 6B shows a detailed view of the cross-sectional view of the sole of FIG. 6A according to embodiments.
Figure 7:
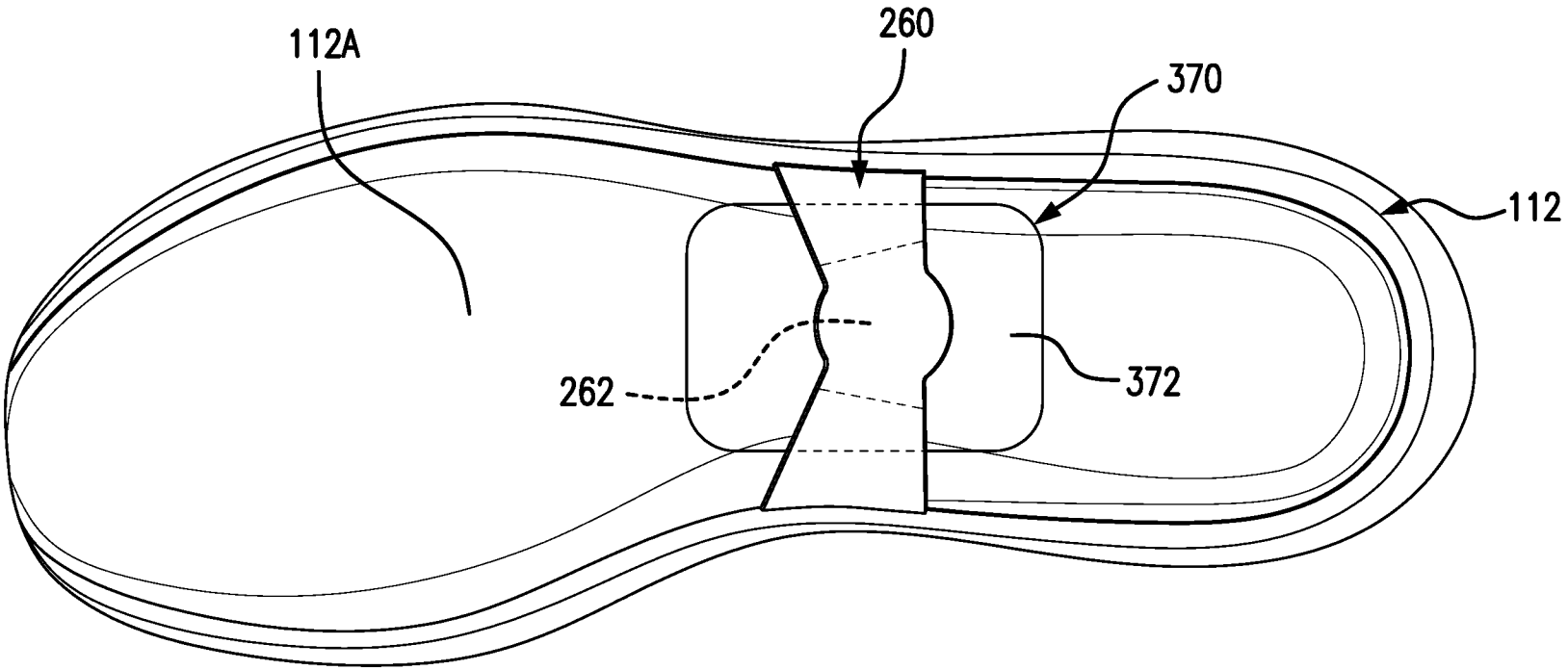
FIG. 7 shows a top view of a sole with a vacuum pump assembly according to embodiments.

In some embodiments, as shown in FIGS. 6A-B and 8, for example, pump 300 may include a fitting 310 coupled to port 262 of connector conduit 260 to fluidly connect pump 300 to bladder 200. In some embodiments, fitting 310 may define a passage 312 in fluid communication with bladder 200 via connector conduit 260. In some embodiments, fitting 310 may include an orifice member 314 disposed in the passage 312 and defining an orifice 315 to restrict air flow through fitting 310. In some embodiments, fitting 310 may be comprised of a molded urethane.

In some embodiments, as shown in FIGS. 6A-B and 8, for example, pump 300 may include a first valve 320 disposed in passage 312 of fitting 310. In some embodiments, first valve 320 may be biased at a closed position to seal passage 312 and configured to move to an open position to allow air to release from bladder 200 through passage 312. In some embodiments, first valve 320 may include a stem 322 slidably received through orifice 315, a collar 324 disposed at a first end of stem 322, and a flap 326 disposed at a second end of stem 322. In some embodiments, when first valve 320 is set at the closed position, collar 324 may be configured to rest against an upper side of orifice member 314, and flap 326 may be configured to rest against a lower side of orifice member 314 to provide an air tight seal along orifice 315, thereby keeping air from escaping bladder 200 through passage 312. In some embodiments, when first valve 320 moves to open position, collar 324 may be spatially separated from the upper side of orifice member 314, and flap 326 may be lifted off the lower side of orifice member 314 to permit air flow through orifice 315, thereby allowing air to release from bladder 200 through passage 312.

In some embodiments, as shown in FIGS. 6A-B and 8, for example, pump 300 may include a base 330 coupled to fitting 310 and second portion 374 of deflection plate 370 so that base 330 is secured within midsole 112. In some embodiments, base 330 may be disc-shaped and include a cylindrical sidewall 332. In some embodiments, base 330 may include a flange 334 projecting from an end of sidewall 332 and secured against deflection plate 370. In some embodiments, base 330 may define a central opening 336 coaxially-aligned with passage 312 of fitting 310. In some embodiments, fitting 310 may be received in opening 336 of base 330, such that passage 312 extends through opening 336 and into through-hole 376 of deflection plate 370. In some embodiments, base 330 may be comprised of a metal material, a plastic material, or a combination thereof.

In some embodiments, as shown in FIGS. 6A-B and 8, pump 300 may include a plunger 340 received on base 330. In some embodiments, plunger 340 may be configured to automatically actuate pump 300 in response to an application of force against sole 110 such that pump 300 permits air to be removed from bladder 200 through passage 312 of fitting 310. In some embodiments, plunger 340 may be configured to automatically actuate pump 300 repeatedly (e.g., as the wear is engaged in a running-based activity) such that pump 300 generates a vacuum within bladder 200. In some embodiments, plunger 340 may be configured to slide along base 330 between a first position, where plunger 340 is spatially separated from first valve 320, and a second position, where plunger 340 forces first valve 320 to move from the closed position to the open position.

In some embodiments, plunger 340 may be disc-shaped and include a peripheral rim 342 aligned with flange 334 of base 330. In some embodiments, peripheral rim 342 may be configured to slide along sidewall 332 of base 330 as plunger 340 moves between first and second positions. In some embodiments, plunger 340 may include a throat 344 defining a slot 346 coaxially aligned with passage 312 of fitting 310 and opening 336 of base 330. In some embodiments, throat 344 may include an orifice member 348 disposed along slot 346 and defining an orifice 349 to restrict air flow through throat 344 of plunger 340. In some embodiments, throat 344 is located along a central portion of plunger 340, and rim 342 extends around throat 344 such that a cavity 345 is defined between an outer surface of throat 344 and an inner surface of rim 342. In some embodiments, plunger 340 may be comprised of a metal material, a plastic material, or a combination thereof.

In some embodiments, when plunger 340 is set in the first position, sidewall 332 of base 330 may be partially received within cavity 345 of plunger 345, and throat 344 of plunger 340 may be disposed outside of passage 312 of fitting 310. In some embodiments, when plunger 340 is set at the second position, sidewall 332 of base 330 may be fully received within cavity 345 of plunger 340, and throat 344 of plunger 340 may be partially disposed within passage 312 of fitting 310.

Figure 9:
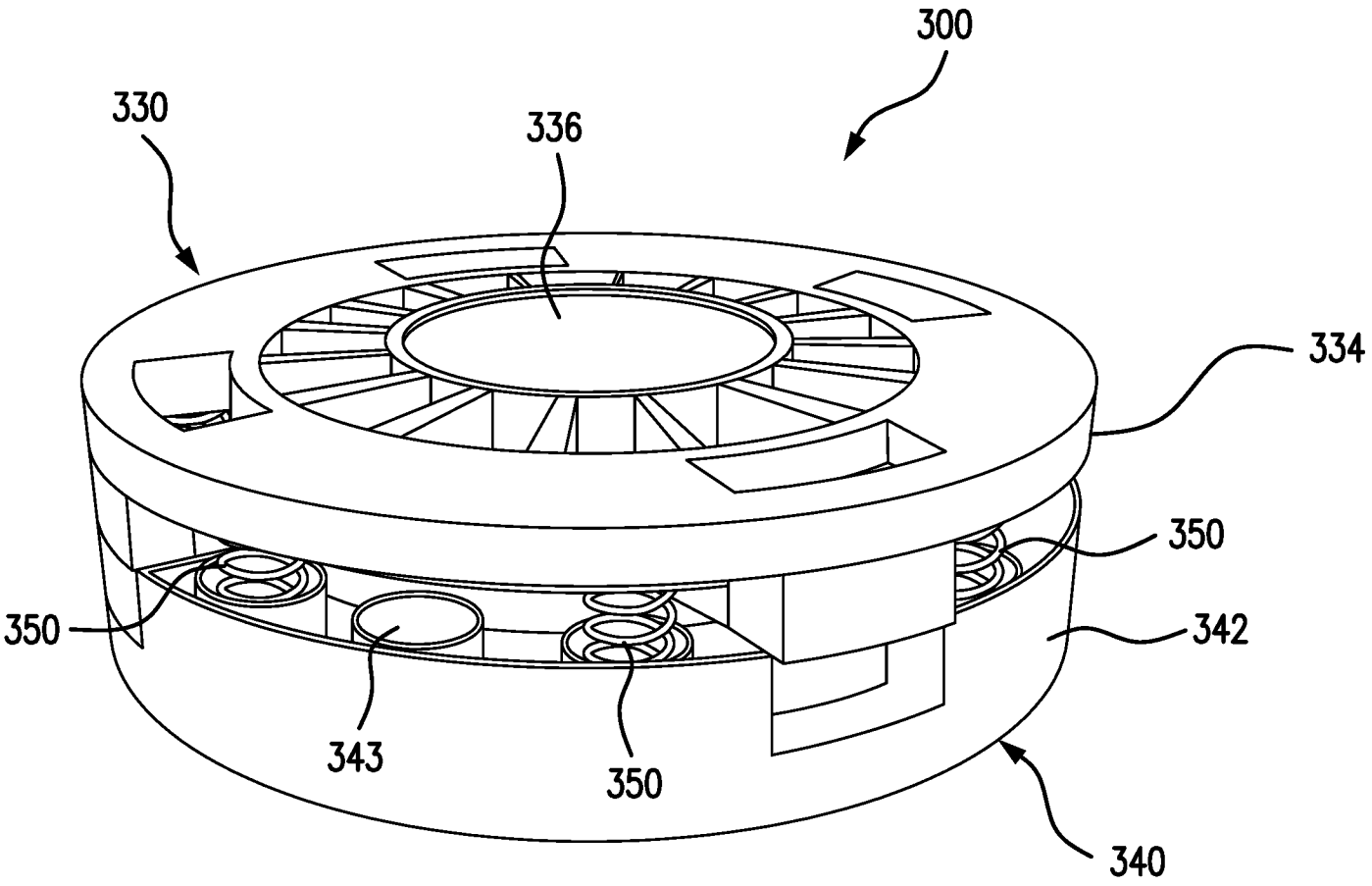
FIG. 9 shows a perspective view of a pump according to embodiments.
Figure 10:
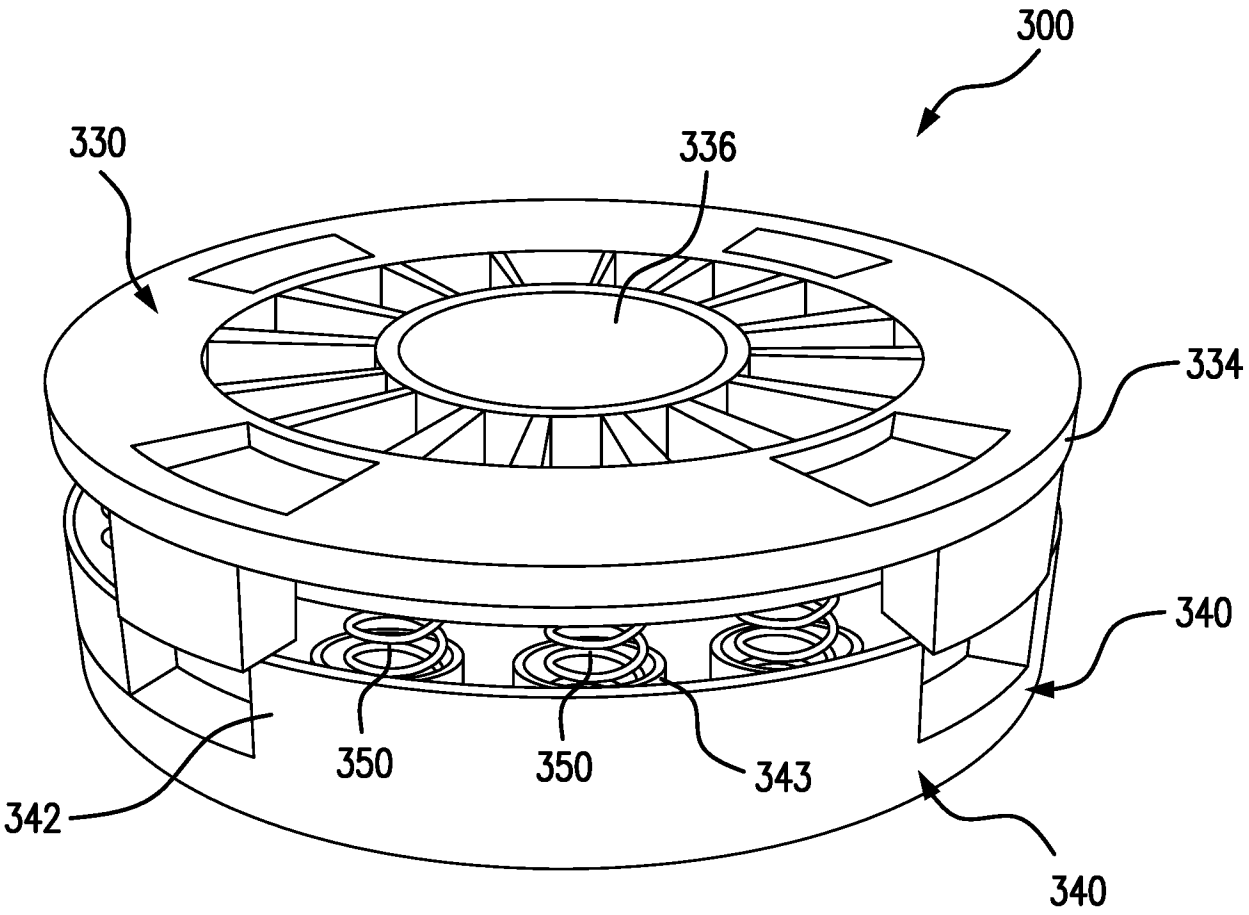
FIG. 10 shows a perspective view of a pump according to embodiments.

In some embodiments, plunger 340 may be biased at the first position. In some embodiments, pump 300 may include a plurality of springs 350 disposed between flange 334 of base 330 and rim 342 of plunger 340 to bias plunger 340 at the first position. In some embodiments, as shown in FIGS. 6A-B, 9, and 10, for example, peripheral rim 342 may define a plurality of ducts 343 for receiving springs 350. In some embodiments, as shown in FIGS. 9 and 10, for example, the number of springs 350 disposed between flange 334 of base 330 and rim 342 of plunger 340 may be altered to modify the magnitude of bias force acted against plunger 340, ultimately modifying the air flow rate expelled through pump 300 and thereby allowing the reservoir of the bladder to reach a lower negative pressure. In some embodiments, as shown in FIG. 9, for example, a first number of springs 350 are disposed between flange 334 of base 330 and rim 342 of plunger 340. In some embodiments, as shown in FIG. 10, a second number of springs 350 are disposed between flange 334 of base 330 and rim 342 of plunger 340, in which the second number of springs 350 is greater than the first number of springs 350.

In some embodiments, as shown in FIGS. 6A-B and 8, for example, pump 300 may include a second valve 360 disposed in slot 346 of throat 344. In some embodiments, second valve 360 may be biased at a closed position to seal slot 346 and configured to move to an open position to permit airflow through opening 346. In some embodiments, second valve 360 may include a stem 362 slidably received through orifice 349, a collar 364 disposed at a first end of stem 362, and a flap 366 disposed at a second end of stem 362. In some embodiments, when second valve 360 is set at the closed position, collar 364 may be configured to rest against an upper side of orifice member 348, and flap 366 may be configured to rest against a lower side of orifice member 348 to provide an air tight seal along orifice 349, thereby keeping air from escaping passage 312 through opening slot 346. In some embodiments, when second valve 360 moves to open position, collar 364 may be spatially separated from the upper side of orifice member 348, and flap 366 may be lifted off the lower side of orifice member 348 to permit air flow through orifice 349, thereby expelling air out of pump 300.

In some embodiments, when no force is being applied to bottom of sole 110 (e.g., before heel strike of wearer's gait cycle), springs 350 bias plunger 340 away from base 330 of pump 300 at the first position, such that first valve 320 and second valve 360 are set at closed positions sealing airflow through pump 300. In some embodiments, when force is applied against the bottom of sole 110 (e.g., during heel strike or midstance of wearer's gait cycle), the applied force overcomes the bias of springs 350, so that plunger 340 moves from the first position to the second position. In some embodiments, as the plunger 340 moves from the first position to the second position, throat 344 is partially received in passage 312 of fitting 310 (e.g., such that throat 344 and second valve 360 abut first valve 320), thereby forcing first valve 320 and second valve 360 to move to open positions. In some embodiments, when first valve 320 and second valve 360 reach open positions, pump 300 expels air out of bladder 200 through passage 312 and slot 346 into the atmosphere.

C. Actuator

In various embodiments, actuator 400 may be disposed in sole 110 and operatively connected to pump 300. In some embodiments, as shown in FIGS. 4-6, for example, actuator 400 may be disposed in a recess 115 of outsole 114 located along midfoot region 102 of athletic shoe 100, in which recess 115 is aligned with cavity 113 of midsole 112. In some embodiments, actuator 400 may be disposed in recess 115 of outsole 114 located along heel region 101 of athletic shoe 100, in which recess 115 is aligned with cavity 113 of midsole 112. In some embodiments, actuator 400 may be centrally located between medial and lateral sides of shoe 100. In some embodiments, actuator 400 may be disposed adjacent to one of the medial and lateral sides of shoe 100.

In various embodiments, actuator 400 may be configured to reinforce actuation of pump 300 in response to the application of force against sole 110 such that pump 300 generates a vacuum within bladder 200. In some embodiments, actuator 400 may include a combination of one or more biasing members (e.g., helical-coil springs, leaf spring, resilient strip) and push plates operatively connected to the pump 300 to translate force applied against the bottom of sole 110 to plunger 340, thereby activating pump 300 for air removal. In some embodiments, actuator 400 may include an electrical component, for example, such as a solenoid or a motor, to reciprocate plunger 340, even when force is not applied against the bottom of sole 110.

In some embodiments, as shown in FIGS. 6A-B, for example, actuator 400 may include a push plate 410 disposed in recess 115 of outsole 114 and a spring 420 disposed between push plate 410 and pump 300 such that spring 420 biases push plate 410 away from pump 300. In some embodiments, push plate 410 may include a flat bottom surface 412 for engaging an interior surface of outsole 114, an upper surface 414 facing a bottom surface 341 of plunger 340, and a neck 416 disposed along upper surface 414. In some embodiments, spring 420 may include a first end 422 coupled to neck 416 of push plate 410 and a second end 424 secured against a bottom surface 341 of plunger 340.

In some embodiments, when no force is being applied to bottom of sole 110 (e.g., before heel strike of wearer's gait cycle), spring 420 biases push plate 410 away from plunger 340 of pump 300, and springs 350 bias plunger 340 away from base 330 of pump 300 at the first position, such that first valve 320 and second valve 360 are set at closed positions sealing airflow through pump 300. In some embodiments, when force is applied against the bottom of sole 110 (e.g., during heel strike or midstance of wearer's gait cycle), the applied force overcomes the bias of spring 420, so that push plate 410 moves toward pump 300 and abuts against bottom surface 341 of plunger 340. In some embodiments, the force applied by push plate 410 against plunger 340 overcomes the bias of springs 350 so that plunger 340 moves from the first position to the second position. In some embodiments, as the plunger 340 moves from the first position to the second position, throat 344 is partially received in passage 312 of fitting 310, thereby forcing first valve 320 and second valve 360 to move to open positions. In some embodiments, when first valve 320 and second valve 360 reach open positions, pump 300 expels air out of bladder 200 through passage 312 and slot 346 into the atmosphere.

In some embodiments, when a wearer is engaged in a walking or running activity, repetitive foot strike against bottom of sole 110 causes substantially continuous reciprocating motion of push plate 410 and plunger 340, thereby allowing pump 300 to generate a vacuum within bladder 200 (e.g. channels 210 hold a vacuum). In some embodiments, as pump 300 removes air from bladder 200 to draw a vacuum, bladder 200 is configured to constrict and conform upper 120 against a wearer's foot, thereby providing a tight, comfortable fit between shoe 100 and the wearer's foot.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An article of footwear comprising:

a sole;

an upper coupled to the sole;

a flexible bladder coupled to the upper; and a pump disposed in the sole and in fluid communication with the bladder, the pump configured to remove air from the bladder to generate a vacuum within the bladder, wherein the pump comprises:

a base having a cylindrical-shaped sidewall and a flange projecting from an upper end of the sidewall, a plunger received on the sidewall of the base, wherein the plunger is configured to slide along the sidewall of the base to activate the pump to remove air from the bladder in response to an application of force against the sole, and a spring received between the flange of the base and the plunger, wherein the spring is configured to bias the plunger away from the flange of the base, wherein as the pump removes air from the bladder to generate the vacuum, the bladder is configured to constrict and conform the upper against a wearer's foot.

2. The article of claim 1, wherein the sole comprises a midsole and an outsole coupled to a bottom of the midsole, and the pump is disposed within a cavity of the midsole.

3. The article of footwear of claim 2 further comprising:

a deflection plate disposed in the cavity of midsole and flush along an upper surface of the midsole, the deflection plate securing the pump within the cavity of the midsole.

4. The article of footwear of claim 1, wherein the pump is disposed in a heel region of the sole.

5. The article of footwear of claim 1, wherein the pump is disposed in an arch region of the sole.

6. The article of footwear of claim 1, wherein the pump comprises:

a fitting received in the base, the fitting defining a passage in fluid communication with the bladder;

a first valve disposed in the passage, the first valve is biased at a closed position to seal the passage and configured to move to an open position to release air from the bladder through the passage.

7. The article of footwear of claim 6, wherein the plunger is configured to slide toward the flange of the base from a first position to a second position, wherein the spring biases the plunger at the first position, and upon the application of force against the sole, the plunger is configured to slide along the sidewall of the base to the second position, and wherein upon sliding along sidewall of the base from the first position to the second position, the plunger is configured to force the first valve to move to the open position such that air is removed from the bladder.

8. The article of footwear of claim 7, wherein the plunger comprises a throat defining an slot aligned with the passage of the fitting and a second valve disposed in the slot of the throat, the second valve is biased at a closed position to seal the slot and configured to move to an open position to permit airflow through the slot, wherein the plunger is set at the second position, the second valve moves to the open position releasing air from the passage of fitting through the slot of the throat.

9. The article of footwear of claim 7, wherein the plunger comprises a peripheral rim aligned with the flange of the base, and wherein the pump comprises a plurality of springs received in the rim of the plunger and coupled to the flange of the base to bias plunger at the first position.

* * * * *